United States Patent [19]

Klahold

[11] Patent Number: 4,993,898

[45] Date of Patent: Feb. 19, 1991

[54] APPARATUS AND SYSTEM FOR TYING DOWN CARGO

[75] Inventor: John A. Klahold, Red Lion, Pa.

[73] Assignee: Babcock Industries Inc., Fairfield, Conn.

[21] Appl. No.: 284,144

[22] Filed: Dec. 14, 1988

Related U.S. Application Data

[63] Continuation-in-part of Ser. No. 36,044, Apr. 8, 1987, abandoned.

[51] Int. Cl.[5] ..... B65D 63/00; B61D 3/16; B60P 7/12

[52] U.S. Cl. ..... 410/12; 410/37; 410/103

[58] Field of Search ..... 410/10, 11, 4, 23, 30, 410/34, 100, 20

[56] References Cited

U.S. PATENT DOCUMENTS

| | | | |
|---|---|---|---|
| 891,974 | 6/1908 | Barrott | 254/230 |
| 1,466,784 | 9/1923 | Brautigam | 254/369 |
| 1,937,769 | 12/1933 | Lute | 410/20 |
| 1,990,562 | 2/1935 | Otis | 410/67 |
| 2,020,270 | 11/1935 | Wilson et al. | 410/9 |
| 2,028,574 | 1/1936 | Tobin et al. | 410/10 |
| 2,046,855 | 7/1936 | Tobin | 410/20 |
| 2,047,503 | 7/1936 | Wilson et al. | 410/20 |
| 2,055,829 | 9/1936 | Tobin | 410/20 |
| 2,078,700 | 4/1937 | Tobin | 410/16 |
| 2,178,693 | 11/1939 | McMullen | 410/21 |
| 2,205,273 | 6/1940 | Radey | 410/10 |
| 2,227,870 | 1/1941 | Thomas | 410/10 |
| 2,628,397 | 2/1953 | Olson | 410/103 |
| 2,927,771 | 3/1960 | Clark | 254/369 |
| 2,946,563 | 7/1960 | Eaton | 410/37 |
| 2,969,023 | 1/1961 | Chapman et al. | 410/12 |
| 3,038,740 | 6/1962 | Blunden | 410/12 |
| 3,120,375 | 2/1964 | Haynes | 410/23 |
| 3,140,850 | 7/1964 | Packard | 410/10 |
| 3,157,133 | 11/1964 | Wojcikowski | 410/12 |
| 3,158,108 | 11/1964 | Sharp | 410/103 |
| 3,181,886 | 5/1965 | Blunden et al. | 410/12 |
| 3,187,686 | 6/1965 | De Podesta | 410/12 |
| 3,324,807 | 6/1967 | Broling | 410/12 |
| 3,374,008 | 3/1968 | Blunden et al. | 410/12 |
| 3,409,263 | 11/1968 | Jantzen | 410/103 |
| 3,507,471 | 4/1970 | Haines, Jr. | 410/103 |
| 3,508,502 | 4/1970 | Sims | 410/103 |
| 3,564,577 | 2/1971 | Blunden et al. | 410/12 |
| 3,589,304 | 6/1971 | Haynes | 105/269 |
| 3,650,222 | 3/1972 | Broling et al. | 410/12 |

(List continued on next page.)

FOREIGN PATENT DOCUMENTS

| | | | |
|---|---|---|---|
| 1018006 | 9/1974 | Canada | 410/11 |

OTHER PUBLICATIONS

Japanese Patent Publication No. 61-175134.

*Primary Examiner*—Andres Kashnikow
*Assistant Examiner*—Virna Lissi Mojica
*Attorney, Agent, or Firm*—Pennie & Edmonds

[57] ABSTRACT

An apparatus is disclosed for tying down wheeled vehicles such as automobiles, to a flat bed or other base support by which the vehicles are to be transported. Two wheels which are positioned in fore and aft tandem are each secured to the base support by respective harnesses while a centrally positioned tensioning unit receives chains connected to the harnesses for application of tie-down tension to the chains by simple back and forth motion of a pivotally mounted handle. Between each wheel harness and the chain tensioning unit is provided a chain pocket wheel and ratchet and pawl arrangement in a housing, with means to attach the entire housing and arrangement to the base support so as to transfer the actual chain tension to the ratchet/-pawl arrangement and the base support. The chain tensioning unit includes a unique arrangement by which simple rotation of a cam facilitates either tensioning of the tie-down harnesses or release of the tension on the tie-down harnesses when the handle is rotated in back and forth motion through about a ninety degree arc.

38 Claims, 13 Drawing Sheets

U.S. PATENT DOCUMENTS

| | | | |
|---|---|---|---|
| 3,673,969 | 7/1972 | Peisner et al. | 410/12 |
| 3,679,175 | 7/1972 | Drayton | 410/23 |
| 3,715,994 | 2/1973 | Mietla | 410/12 |
| 3,827,662 | 8/1974 | Krokos | 410/12 |
| 3,842,754 | 10/1974 | Jones | 410/12 |
| 3,853,347 | 12/1974 | Harold | 410/11 |
| 3,860,263 | 1/1975 | Taylor | 410/12 |
| 4,044,691 | 8/1977 | Kilgus | 410/12 |
| 4,045,002 | 8/1977 | Miller | 410/103 |
| 4,063,712 | 12/1977 | Arbogast | 410/37 |
| 4,077,332 | 3/1978 | Krokos | 410/12 |
| 4,147,113 | 4/1979 | Kilgus | 410/8 |
| 4,229,131 | 10/1980 | Hague | 410/12 |
| 4,273,486 | 6/1981 | Tatina | 410/103 |
| 4,367,993 | 1/1983 | Meigs | 410/103 |
| 4,369,009 | 1/1983 | Fulford | 410/35 |
| 4,479,746 | 10/1984 | Huber | 410/21 |
| 4,510,652 | 4/1985 | Van Iperen | 410/12 |
| 4,611,961 | 9/1986 | Van Iperen et al. | 410/20 |

FIG. 21
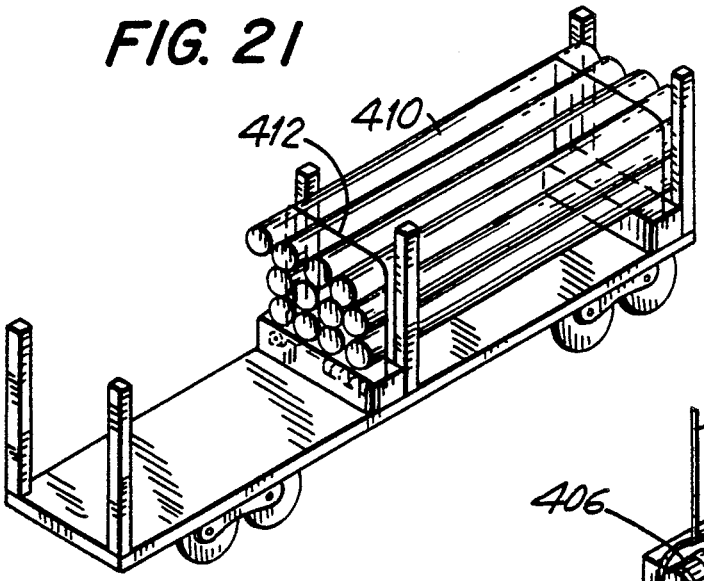
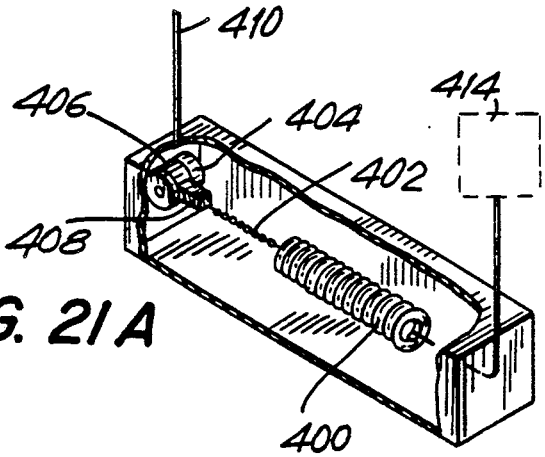
FIG. 21A
FIG. 22
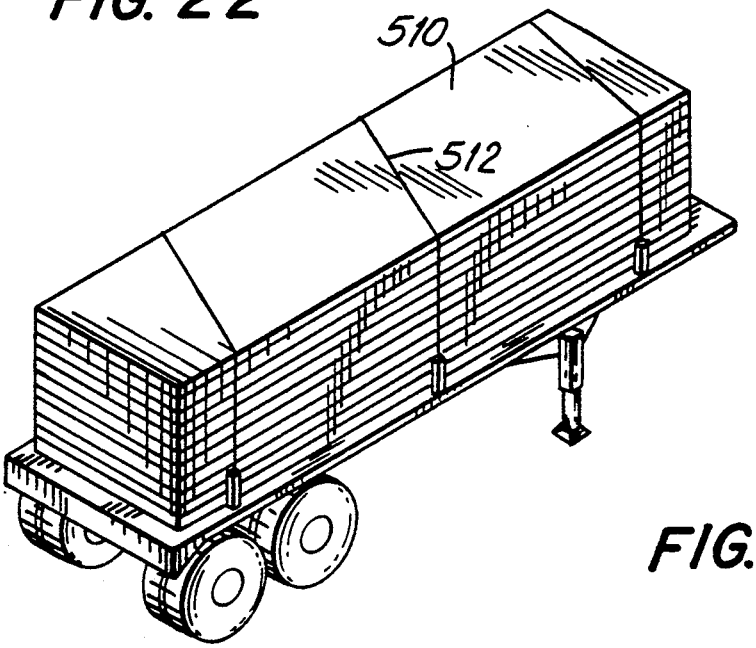
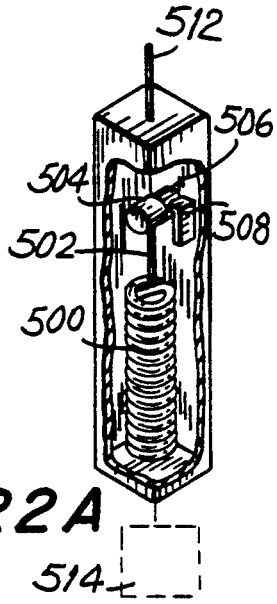
FIG. 22A

APPARATUS AND SYSTEM FOR TYING DOWN CARGO

CROSS REFERENCE TO RELATED APPLICATIONS

This application is a continuation-in-part of application Ser. No. 036,044, entitled "APPARATUS AND SYSTEM FOR TYING DOWN VEHICLES", filed Apr. 8, 1987, which is incorporated herein by reference.

TECHNICAL FIELD

The invention relates to devices for tying down wheeled vehicles for transport on flatbed cars such as rail cars, trailer flatbed or the like.

BACKGROUND ART

It is generally recognized that railroad flatbed cars are efficient and economical means for transporting heavy loads at high speeds and with a high degree of safety. Such loads often are in the form of wheeled vehicles, particularly automobiles, which are required to be tied down to the flatbed surface during transport. Of all of the requirements for tying down automobiles for transport it is most important to provide devices which not only maintain a fixed position of the automobile relative to the flatbed car but also maintains that position during sudden or quick accelerations or stops or even upon relatively minor impacts of the main carrier vehicle.

Transporting automobiles or other wheeled vehicles on railroad flatbed trucks or seagoing vessels in the past has normally been directed to restraining the actual body of the automobile by chains and devices which restrain the body from movement in several directions. Often these devices include a four point chain system emanating from a position centrally located with respect to the automobile and extending in different directions toward the four corners of the frame. Thereafter, one or more ratcheting devices are actuated to place the chains in tension so as to restrain the automobile from movements during transit.

These prior art devices have been known to suffer from several diverse deficiencies. For example, they provide relatively extensive interference to the movement of the automobiles on the flatbed. In some instances where an automobile has a relatively low chasis it has been found that the bulk and interference of the chains and related tensioning equipment actually interfere with the frame of the automobiles thereby preventing them from movements into and out of position on the flatbed.

One prior art system includes hold-down devices for automobiles which surround a major portion of the individual automobile wheels and are each provided with a tensioning mechanism to secure the wheel against the base support. Another system provides individual wheel hold-down harnesses and wheel chocks positioned on each side of the wheel and provided with a crank and associated hardware mechanism for applying tension to the harness while jamming the chocks against the wheel. Still another system includes a multiple chain and ratchet system to secure the frame of the vehicle to the flatbed with the ratchet system maintaining the tension thus applied to the chains. In general, there are numerous systems for tying down or otherwise securing automobiles or other wheeled vehicles to flatbed transport cars. These systems often include common hook-type and chain hardware, cranks, ratchet wheels or the like. However, although many of these systems are usually only effective in applying tension to chains or harnesses which hold down selected components of the automobile, none of them are capable of maintaining the tension thus applied or even taking-up slack in the tie-down devices caused by minor aberrations or changes generally occurring in the tension system during transport. For example, on occasion the main transport vehicle in a minor accident will undergo impact with another automobile causing shifting of the transport vehicles with resultant stretching of components or distortion of tires at critical locations. When such incidents occurred with prior art systems, these systems do not have the capability of automatically replacing the resultant lost tension on the major tie-down components to thereby take-up the slack created during the disturbances. Accordingly, when a disturbance does occur, resumption of motion of the flatbed is normally prevented by the fact that some or most of the vehicles previously tied down have worked themselves loose. Further, these prior art devices do not include features to transfer the main tension carrying load within a chain or other tie-down component so as to shift that tension load to a major load carrying portion of the flatbed vehicle while protecting the main tensioning mechanism from fluctuations in tension caused by impact of the main vehicle or quick accelerations or decelerations thereof. I have invented an apparatus and system for tying down wheeled vehicles which avoids all of the aforementioned disadvantages of the prior art devices.

SUMMARY OF THE INVENTION

An apparatus and system is disclosed for tying down wheeled vehicles to a base support which comprises, means for tying down a first wheel of a vehicle to a base support, means for tying down a second wheel correspondingly positioned in tandem with the first wheel, means for continuously applying tension to the tie-down means of the first and second wheels, and means interposed between said tensioning means and said first and second wheels for rigidly securing said tying means to said base support respectively with respect to each wheel so as to prevent relaxation of tension applied thereto. The tension applied to the tie-down means of the first and second wheels is simultaneously maintained.

In a preferred embodiment an apparatus is disclosed for tying down a wheeled vehicle to a base support, the vehicle having at least a first front wheel and a second rear wheel positioned in general tandem alignment with the front wheel, which comprises, first wheel tie-down means for encompassing at least a portion of the first wheel, the first wheel tie-down means having means at a first end portion for securement thereof to the base support, second wheel tie-down means for encompassing at least a portion of the second wheel, the second wheel tie-down means having means at a first end portion for securement thereof to the base support, means for selectively and simultaneously applying tension to at least one end portion of each of the first and second wheel tie-down means, means interposed between said tension applying means and said first wheel tie-down means for rigidly securing said first wheel tie-down means to the base support at a second end portion so as to prevent relaxation of tension applied to said first wheel while permitting the application of additional tension as required, and means interposed between said tension applying means and said second wheel for rigidly securing said second wheel tie-down means to the base support at a second end portion so as to prevent relaxation of tension applied to said second wheel while permitting the application of additional tension as required. The predetermined tension applied to the first and second wheel tie-down means is automatically increased in response to decreases in tension occurring for any reason.

The apparatus according to the invention includes a base support means in the form of a support plate defining a plurality of slots for reception of wheel tie-down devices. This support plate is preferably welded to a first bed of a rail car.

Wheel harnesses are adapted to encompass at least a portion of the first wheel and include tie-down "T"-shaped hooks means dimensioned and configured for insertion into the slots of the base support plate and rotated to interference relation therewith so as not to be readily removable. The harnesses are preferably constructed of synthetic fiber webbing such as nylon or polyester, but may be made of any strong durable material having little stretch under tension.

Chains are connected from each nylon harness and extend into a unit for applying tension to the chains to promote tie-down of the first and second wheel tie-down means.

The tensioning unit includes two gear racks and common pinion connected to a pivotally attached handle with ratchet and dual pawls for alternate engagement with the ratchet to provide stepped rotation of the ratchet and pinion. The tensioning unit also includes a coil spring attached to one end of each associated elongated rack member and at the other end to an associated wheel chain.

At least two pawls are pivotally arranged and biased for selective and sequential movement into and out of engagement with the teeth of the ratchet wheel such that rotation of the ratchet means and the pinion gear against the tension forces provided by the resilient spring means alternately transfers the forces from the tension between the first and second pawls as the ratchet means and the pinion means are simultaneously rotated. The handle is preferably connected for rotation with the ratchet and the pinion for providing selective rotation of the ratchet means and the pinion means when the handle means is rotated to thereby cause the elongated gear racks to move in parallel directions toward each other to apply tension to the wheel chains.

Means for releasing tension to the elongated gear racks and the wheel chains comprises cam means pivotally attached to one of the pawls and dimensioned and configured for engagement by at least a portion of the handle means when the handle means is rotated in a predetermined direction relative to the pawls to sequentially disengage each of the pawls from the ratchet means so as to facilitate corresponding stepped rotation of the ratchet means and the pinion means in a direction to cause the elongated rack members to move away from each other to thereby reduce the tension applied to the chain means when the cam is rotated to its second position it no longer interferes with the handle and ratchet and pawl operation and thus rotates the ratchet and pinion in steps in a direction to increase the tension on the tie-down chains and harnesses.

A bracket is selectively secured to the base support plate by means of a "T" hook having a "T" configuration, each the hook being inserted into a selective adjacent slot in the base support plate and rotated to an interfering relation with the base support plate to prevent removal of the "T" hook when tension is applied thereto by the wheel chains and the tension applying means. The bracket contains a ratchet and pawl arrangement to transfer the tension forces to the bracket and thereby to the base plate of the apparatus.

In particular, the invention relates to an apparatus for tying down a wheeled vehicle to a base support, the vehicle having at least a first front wheel and a second rear wheel positioned in general tandem alignment with the first front wheel, which comprises base support means dimensioned and configured for supporting at least the first and second wheels of the vehicle, first wheel tie-down means for encompassing at least a portion of the first wheel, the first wheel tie-down means having means at each end portion for securement to the base support and chain means connected to one end portion for applying tie-down forces thereto by applying tension to the chain means, second wheel tie-down means for encompassing at least a portion of the second wheel, the second wheel tie-down means having means at each end portion for securement to the base support and chain means connected to one end portion for applying tie-down forces thereto by applying tension to the chain means, means for selectively and simultaneously applying and maintaining tension to at least one end portion of each of the first and second wheel tie-down means and associated chain means and for continuously maintaining the wheel tie-down means in a predetermined tensioned condition, means interposed between the tension applying means and the first wheel tie-down means for rigidly securing the first wheel tie-down means to the base support means so as to prevent relaxation of tension applied thereto by the tension applying means while permitting increases in tension when the tension decreases below a predetermined value, and means interposed between the tension applying means and the second wheel tie-down means for rigidly securing the second wheel tie-down means to the base support means so as to prevent relaxation of tension applied thereto by the tension applying means while permitting increases in tension when the tension decreases below a predetermined value.

A system is disclosed for tying down a wheeled vehicle to a base support, the vehicle having at least a first front wheel and a second rear wheel positioned in tandem alignment with the front wheel which comprises a base support plate dimensioned and configured for supporting at least the first and second wheels of the vehicle. The base support plate has a plurality of slots positioned for reception of wheel tie-down hooks, a first wheel tie-down harness dimensioned and configured for encompassing at least a portion of the first wheel, the first wheel tie-down harness having a tie-down securement hook positioned at each end for securement to the base support plate. A second wheel tie-down harness is dimensioned and configured for encompassing at least a portion of the second wheel, the second wheel tie-down harness having a tie-down securement hook positioned at each end for securement to the base support plate. Means for selectively applying and maintaining tension to at least one portion of each of the first and second wheel tie-down harnesses and for continuously maintaining the wheel tie-down harnesses in a predetermined tensioned condition is provided which comprises, a housing, two opposed toothed gear racks positioned within the housing and mounted for relative parallel movements toward and away from each other, and a pinion mounted within the housing for rotational simultaneous toothed engagement with the gear racks so as to provide movement of the racks toward and away from each other depending upon the direction of the pinion gear. A coil spring is attached to opposed end portions of each gear rack at one end and at the other end, each coil spring is attached to tie-down chains connected to respective opposed end portions of the wheel tie-down harnesses. A toothed ratchet wheel mounted for rotation with the pinion gear and having associated therewith two spaced spring loaded pawls arranged for selective and alternate engagement with the teeth of the ratchet gear as the ratchet gear rotates. A handle is mounted to the housing for pivotal rotation and connected to the ratchet and the pinion so as to simultaneously rotate therewith when the handle is rotated. Cam means is rotatably mounted to one of the pawls and being dimensioned and configured such that rotation of the cam means to a first position causes sequential engagement and disengagement of the pawls so as to release tension on the wheel chains and rotation of the cam means in a second direction removes the cam means into sequential interference relation with the pawls as the handle is rotated in a back and forth motion such that the pawls sequentially rotate the ratchet wheel and pinion in steps and in a direction to cause tensioning of the wheel chains. A bracket is connected to an end portion of each harness to attach each harness to the base support plate and to guide each wheel chain from the harness to the chain tensioning unit. Each bracket contains ratchet and pawl means adapted to maintain tension applied to the associate wheel chain by engagement of the pawl with a tooth on the ratchet to thereby transfer the tension thus applied to each wheel chain and ratchet tooth and the respective bracket and to the base support plate.

In the broadest sense, the present invention relates to an apparatus for tying down cargo to a base support which comprises means configured and adapted to extend about portions of the cargo to be secured to the base support, means for applying tension to the securing means, and means interposed between the tensioning means and the cargo for rigidly restraining the securing means with respect to the cargo so as to prevent relaxation of tension applied to the cargo while continuously permitting the application of tension to the securing means as required to maintain a predetermined tension while the cargo is restrained. Preferably, the means for applying tension includes resilient means. The means for applying tension preferably comprises manually operable winding means connected to the cargo securing means. Also, preferably, the means interposed between the tensioning means and the cargo comprises mechanical means for rigidly restraining the securing means, the mechanical means including means adapted for engagement therewith for permitting increased application of tension to the securing means as may be required, while simultaneously isolating the securing means under tension from the tension applying means. In particular, the means interposed between the tensioning means and the cargo comprises at least one ratchet wheel and associated pawl means fixed with respect to the base support and engaged with at least one tooth of the ratchet wheel, the teeth of the ratchet wheel being configured and dimensioned such that the pawl means prevents rotation of the ratchet wheel in a direction to relax tension on the securing means and the cargo but permits rotation of the ratchet wheel in the opposite direction by increasing tension applied to the securing means by the resilient means. Preferably, the resilient means is a coil spring.

In a preferred embodiment the means for applying tension comprises a gear wheel arranged to be rotated; at least one pawl, the pawl being connected to handle means and the gear wheel being selectively engaged or disengaged by means to retain the position of the gear wheel at a predetermined rotational position corresponding to a predetermined tension applied to the securing means through the gear wheel. The apparatus further comprises means to disengage the means to restrain the ratchet wheel to thereby permit relaxation of tension on the securing means by permitting rotation of the ratchet wheel and the restraining means to relieve the tension on the restraining means. Preferably, the restraining means comprises cable and is connected to a cable spool. The means to disengage the tension comprises handle means positioned in engagement with means connected to the means to secure the position of the ratchet wheel. The means to secure the position of the ratchet wheel is operatively engaged with spring means to bias the means to fix the position of the ratchet wheel toward the loaded position.

The present invention is easily utilized along with existing devices since existing devices are attached to the frame of the automobile and the present apparatus secures two wheels. Also it will be appreciated that a plurality of tensioning units of the present invention can be slidably positioned on a rail car or any base support and each system can be used to tie-down a front and rear wheel of the same vehicle or alternately, the rear wheel of one vehicle and the front wheel of an adjacent vehicle. Also, it will be appreciated that the present apparatus can be used with a plurality of different sized automobiles by merely sliding a plurality of tensioning units in respective positions along an end rail of a flatbed car to accommodate as many automobiles of a given size as will fit on a rail car. The flatbed of the car can be provided with a plurality of continuous slotted base support plates to accept a plurality of cars parked in tandem relation along the length of the flatbed car.

Although my invention includes posts for mounting and storing harnesses, such posts are optional. Further, it should be noted that a significant feature of my invention pertains to the capability to automatically maintain tension of the wheel tie-down chains and to automatically take-up slack in the chains occurring due to temporary or permanent changes in tire shapes, or stretching of equipment due to sudden decelerations or impacts or even sudden accelerations. In the case of a tire going flat, my tension apparatus will take-up any resultant slack in the tie-down chains up to 14 to 16 inches.

BRIEF DESCRIPTION OF THE DRAWINGS

Preferred embodiments of the invention are described hereinbelow with reference to the drawings wherein:

FIG. 21 is a perspective view illustrating an application of the present invention for securing cargo generally as by securing tree logs;

FIG. 21A is an enlarged perspective cut-away view of the log tie-down system of FIG. 21 illustrating the general inventive principle of the present invention;

FIG. 22 is a perspective view illustrating an application of the present invention for securing cargo such as lumber on a wheeled cargo carrying vehicle; and FIG. 22A is an enlarged perspective cut-away view illustrating the general inventive principle of the present invention.

DETAILED DESCRIPTION OF THE PREFERRED EMBODIMENTS

Figure 1:
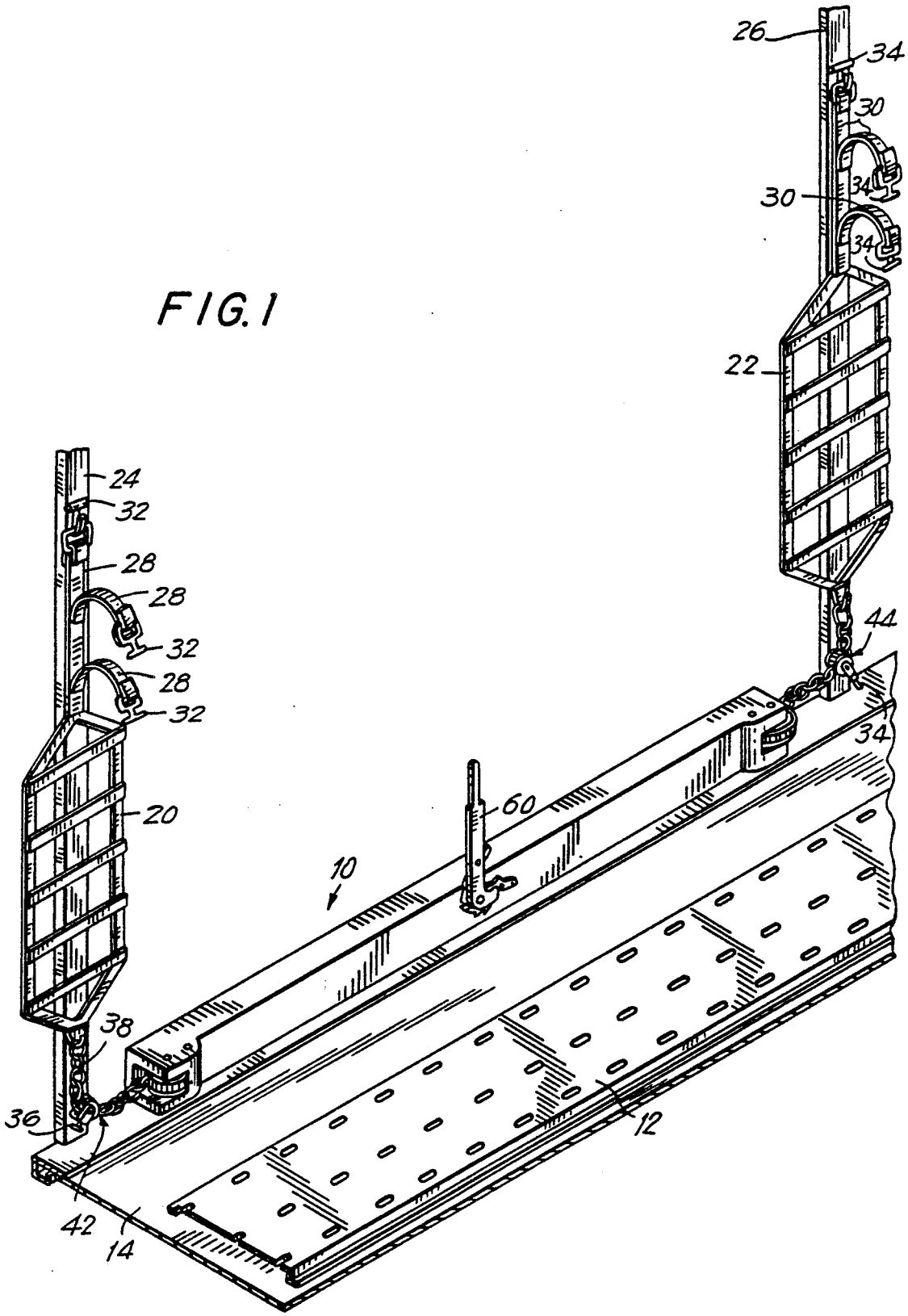
FIG. 1 is a perspective view illustrating an apparatus and system for tying down wheeled vehicles constructed according to the invention.
Figure 2:
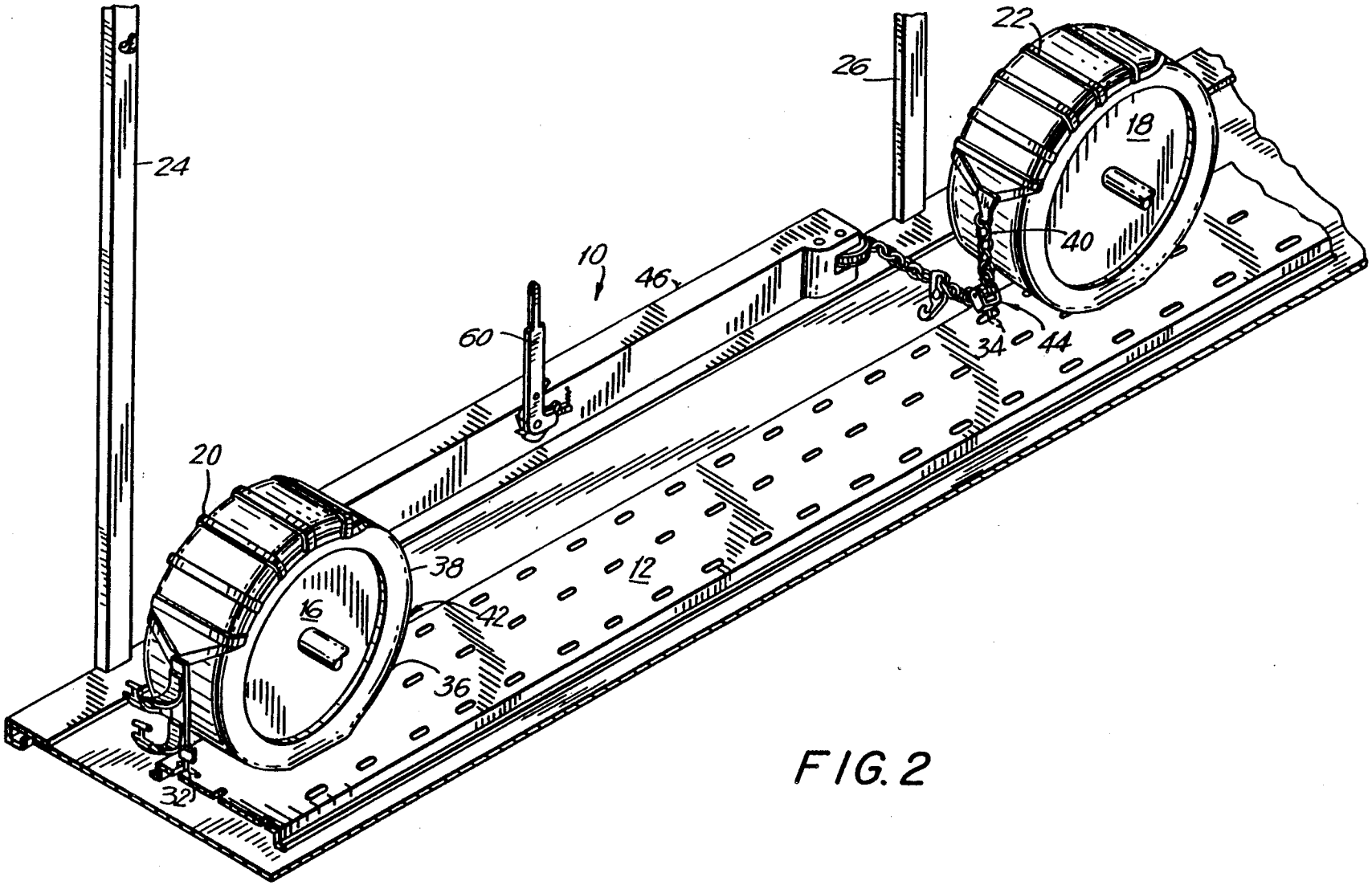
FIG. 2 is a perspective view of the apparatus shown in FIG. 1 illustrating the arrangement for tying down two wheels of a vehicle with the actual vehicle body removed for convenience of illustration.

Referring to FIG. 1 there is illustrated a perspective view of the apparatus 10 and system for tying down wheels constructed according to the present invention. A slotted plate 12 is secured to a common base plate 14 which is in turn secured to a deck of a transporting vehicle or other ground support for reception of each of a forward 16 and rearward 18 wheels of a vehicle to be transported as is shown in FIG. 2. It should be noted that the entire base plate 14 and attached slotted vehicle support plate 12 may be secured to any of a plurality of base supports including the deck of a flatbed truck or the deck of a cargo vessel or any ground support. It may also be secured to a base support of an air transport plane.

Referring to FIG. 1 there is illustrated a front wheel harness 20 and 22 each being stored in position when not in use as shown on respective associated storing posts and 26. Harnesses 20 and 22 are preferably constructed of a strong durable material such as nylon and each is provided with three separately positioned end straps 28 and 30 as shown to accommodate automobile wheels of various sizes. These straps 28 and 30 each respectively contain "T" hooks 32 and 34 as shown for use in securing the associated end of the nylon harness to the deck plate 12 by insertion into the slots of base plate 12 and rotation to prevent withdrawal from the slot in accordance with the arrangements shown in FIG. 2.

Figure 3:
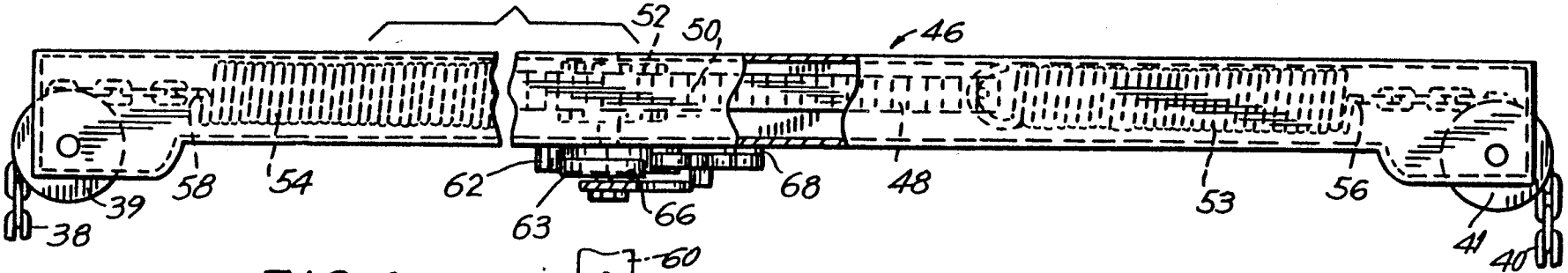
FIG. 3 is a top view partially in cross-section of the central chain tensioning unit of the invention.

Referring now to FIG. 2 in conjunction with FIG. 3 wheels 16 and 18 of a vehicle are located on slotted base plate 12 and the vehicle is secured in position by securing these wheels utilizing nylon harnesses 20 and 22 respectively as shown. The inner end of each nylon harness is secured to the base plate by an appropriate "T" hook 34 and 36 (36 not shown in FIG. 2) and the opposite end of each nylon harness 16 and 18 is respectively secured to base plate 12 by "T" hooks 32 and 34 ("T" hook 34 not shown in FIG. 2). In operation the "T" hooks are dimensioned to be inserted into the slots 11 of base plate 12 and rotated 90 degrees so as to prevent removal of the "T" hooks by the interference relation thereby created. Each inner end of each nylon harness is respectively connected to a tensioning chain 38 and 40 (38 not shown in FIG. 2) which in turn is connected to a base securement bracket 42 and 44 (42 not shown in FIG. 2) having the construction illustrated at 42 in FIG. 11. The housing contains a rotatable chain pocket wheel for engaged reception of the chain in correspondingly configured pockets and a ratchet wheel and pawl arrangement to maintain pre-applied tension on the wheel chain. The pocket wheel receives chain 40 and turns its direction toward the central tensioning unit 46.

Figure 4:
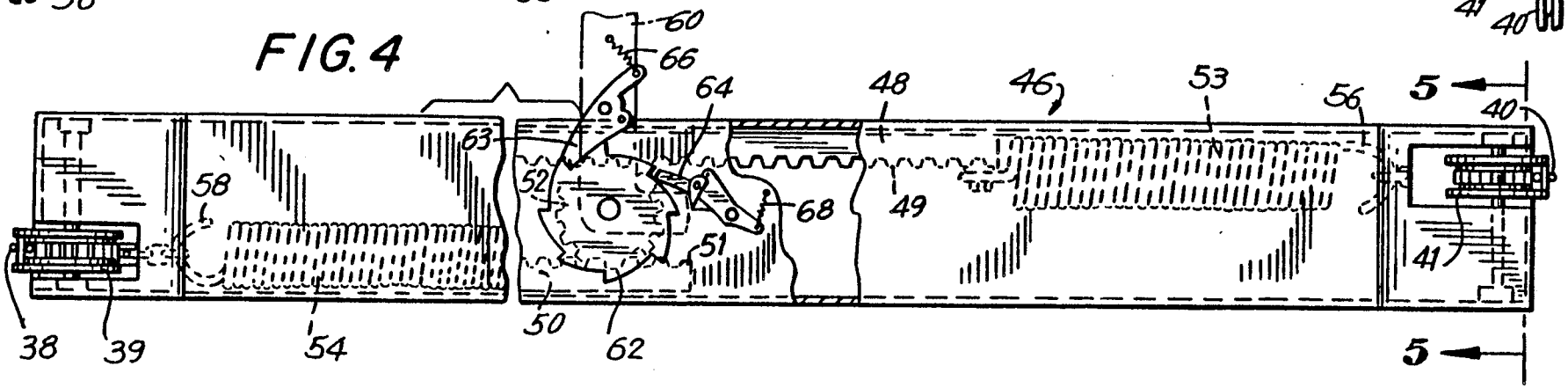
FIG. 4 is a front view partially in cross-section of the central chain tensioning unit shown in FIG. 3.
Figure 5:
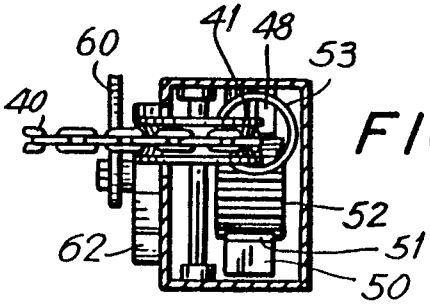
FIG. 5 is a view taken along lines 5—5 of FIG. 4 illustrating the pocket wheel arrangement for guiding and maintaining one wheel loading chain in the proper orientation for tying down the wheel.

Referring now to FIG. 3 there is illustrated a top view, partially in cross-section, of the central chain tensioning unit 46 which forms part of the invention. FIG. 4 illustrates a front view, partially in cross-section, of the central chain tensioning unit 46 of FIG. 3. The chain tensioning unit 46 has positioned therein, spaced elongated toothed racks 48 and 50 which are arranged to shift toward and away from each other by rotational movement of pinion 52 as shown. Each rack 48 and 50 is connected to a respective spring 53 and 54 which in turn are each connected by hook ends 56 and 58 to respective chains 40 and 38. The pinion is connected for rotation with handle 60 which is connected to ratchet 62 as shown in FIG. 4. Handle 60 also has attached thereto pivotal spring loaded pawl 62 and there is also positioned pawl 64 which is spring loaded by spring 68 as shown. Pawl 64 is pivoted to the frame and spring 68 is attached to the frame. Pawl 63 is spring loaded by spring 66.

Referring once again to FIGS. 3 and 4 tensioning of the respective wheel chains 40 and 38 is accomplished by rotating handle 60 in a counterclockwise direction so as to rotate ratchet wheel 62 and pinion 52 by engagement of pawl 63 with a tooth of ratchet wheel 62. Rotation of pinion 52 in turn engages the teeth 49 and 51 of racks 48 and 50 and causes them to move simultaneously toward each other thereby extending springs 53 and 54 and thus applying tensioning to chains 38 and 40. As pawl 63 remains in engagement with the tooth of ratchet wheel 62 as shown, the ratchet wheel and pivot continue to rotate until pawl 64 drops by pressure caused by spring 68 into the next available tooth of ratchet wheel 62 thereby effectively holding ratchet wheel 62 and pinion 52 in this new rotated position. This engagement actually maintains any tension thus far applied to springs 53 and 54 and respective chains 40 and 38. Thereafter, handle 60 is rotated back in a clockwise direction until the end of pawl 63 drops into the next available tooth and the process is repeated until sufficient tension is applied to the respective chains 40 and 38 thus applying sufficient tension to secure the vehicle to the deck.

Chains 38 and 40 are each received in respective pocket wheels 39 and 41 which contain a plurality of successive pockets which alternately receive chain links in nestled relation so as to assist the chain to remain in position in any predetermined, loaded position. Once the chains are tensioned and the vehicle is tied down as shown in FIG. 2 transporting the vehicle can proceed whereby the vehicle is secured and protected against the possibility of relatively quick accelerations and decelerations as well as relatively high impacts of the main transporting vehicle. To protect and preserve the tension which has been applied to the wheel tie-down chains 38 and 40, a tension locking arrangement shown in FIGS. 3 and 4 and is disclosed in greater detail in FIGS. 10 and 11. For convenience of description base securement bracket 42 and associated hardware is shown in FIG. 10; however, base securement bracket 44 associated with wheel 18 is substantially the same as bracket 42, but not shown.

Figure 10:
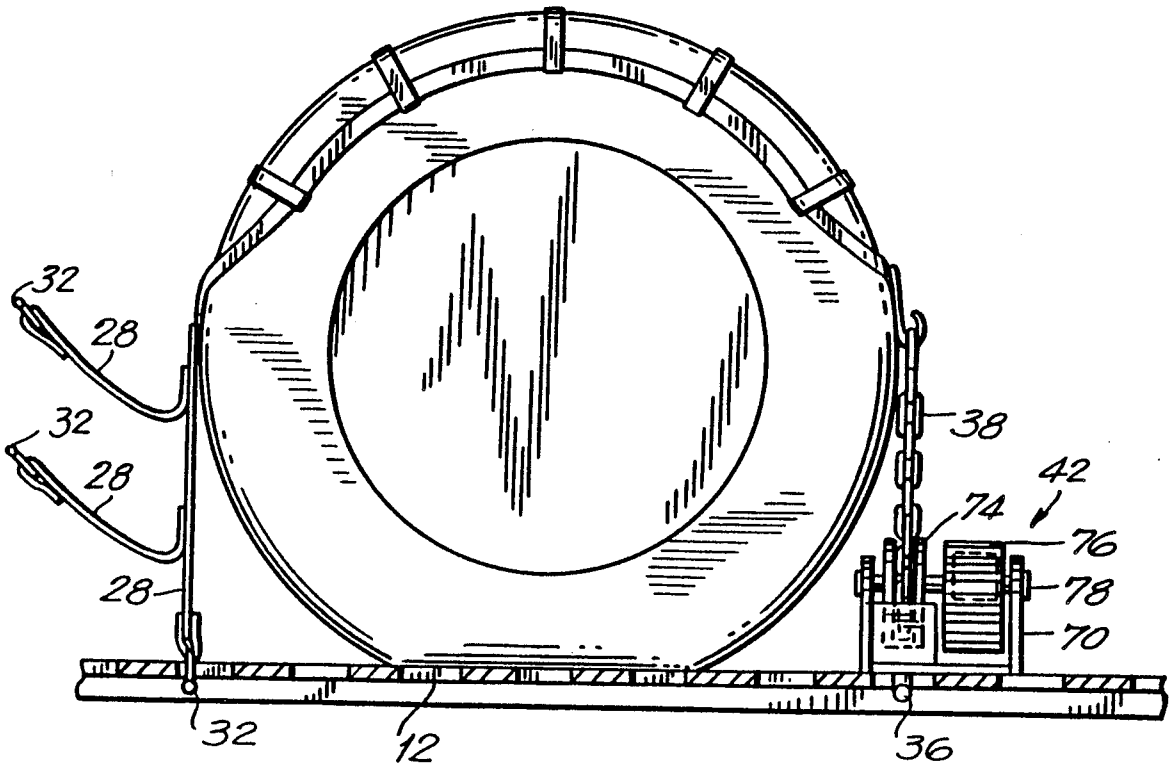
FIG. 10 is a side view of a wheel tied down by a harness to a deck plate with means for maintaining chain tension.

Referring to FIG. 10, a U-shaped bracket 70 is shown. Bracket 70 in FIG. 10 has associated therewith a chain guide 72 with chain pocket wheel 74 and associated ratchet wheel 76 rotatably mounted on shaft 78. Pawl 80 is pivotally mounted to bracket 42 and is spring loaded by a spring (not shown) concentrically positioned on the same shaft as the pawl 80 (behind it in FIG. 11) such that pawl 80 engages successive teeth of ratchet wheel 76. As the respective tension of the chains 38 and 40 is increased pawl 80 engages successive teeth of ratchet wheel 76 so as to maintain the tension on the chain. Thus, in the event of impact of the main vehicle and movement or shifting of the transported vehicle due to high acceleration or the like, this ratchet wheel 76 and pawl 80 effectively transfers the major vehicle stabilizing force to the slotted plate and deck via "T" hook 36 and base securement bracket 42 while at the same time permitting automatic tightening of the chain tension as may be needed while transporting the vehicle as will be described hereinbelow. It should be noted that U-shaped bracket 42 has associated therewith a "T" hook which is readily insertable into the slotted plate and readily removable from the slotted plate as disclosed previously for the "T" hooks. Upon removal the U-shaped bracket 42 is stored as shown in FIG. 1 on its respective support post 24 and 26.

Figure 7:
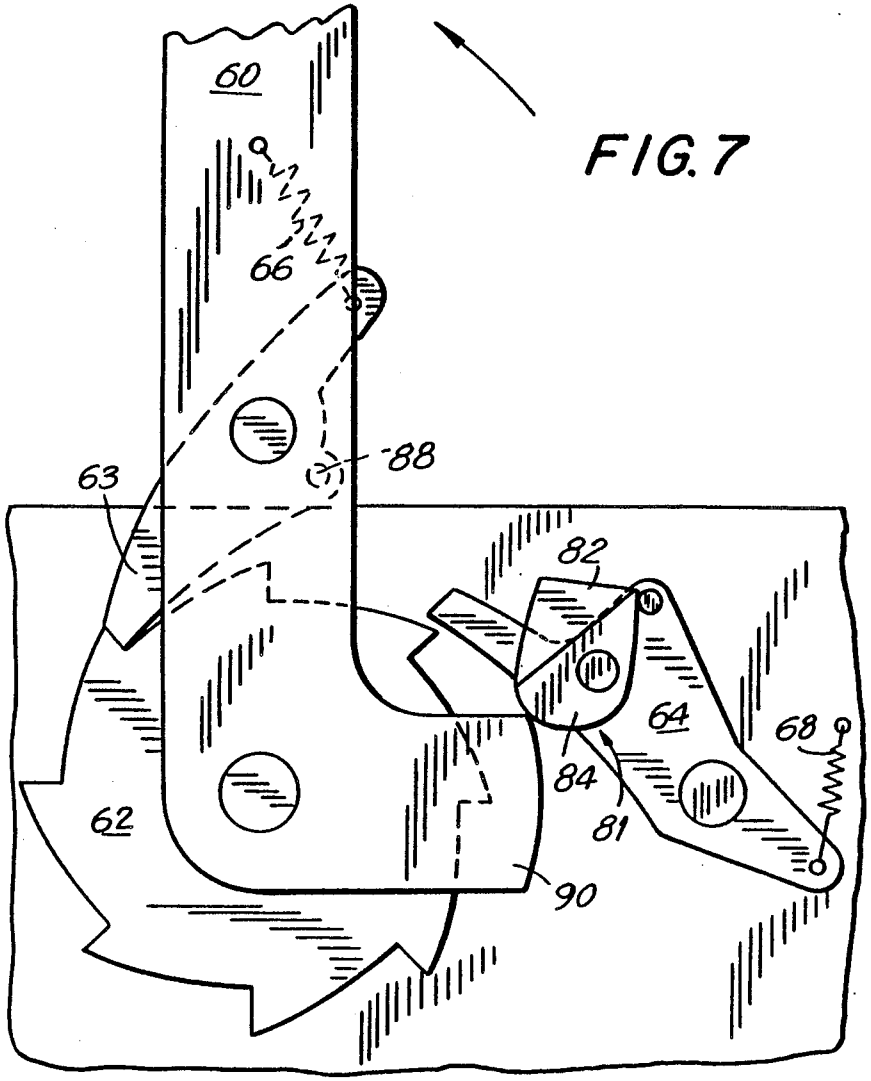
FIGS. 6 and 7 are enlarged sequential views illustrating the tension release mechanism for releasing tension from the chains of the wheel tie-down chains.
Figure 6:
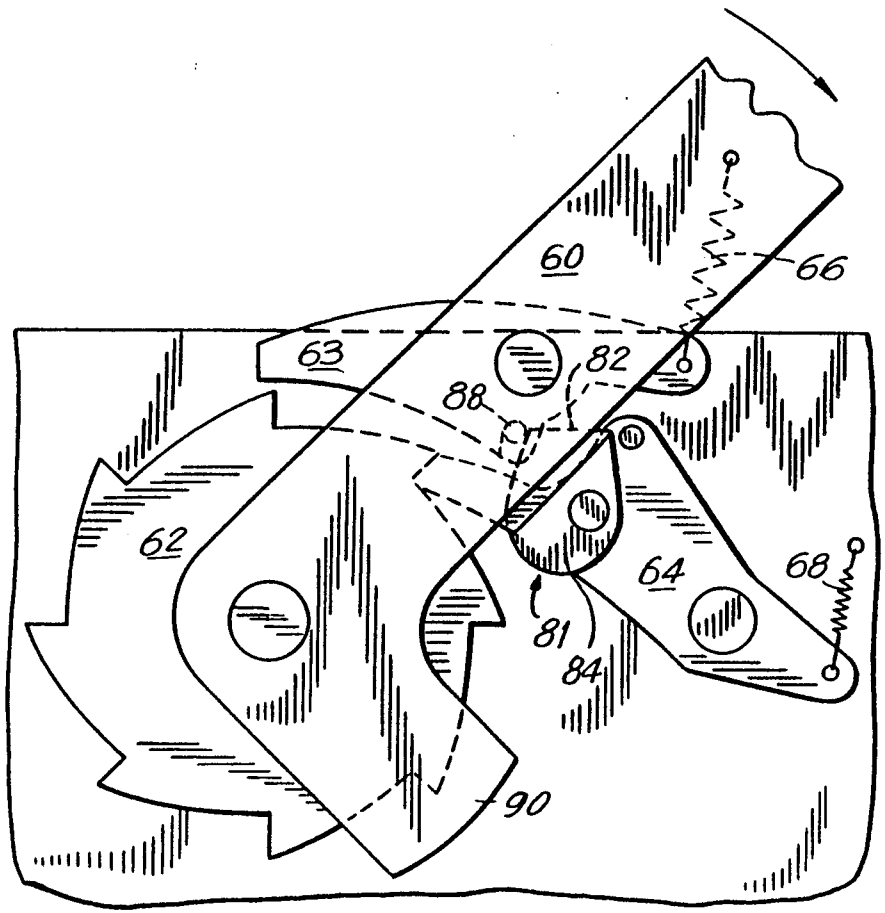

Referring now to FIGS. 6, 7, 8 and 9 there is illustrated the device which permits selective release of chain tension and selective application of tension to the wheel chains 38 and 40 as may be desired by the operator. Initially, the arrangement which facilitates release of chain tension as shown in FIGS. 6 and 7 will be described. In FIGS. 6 and 7 the arrows show the direction of the handle at the end of each stroke as shown.

Referring to FIGS. 6 and 7, there is shown handle 60 and which is attached to ratchet wheel 62 which in turn is engaged by top pawl 63 (attached to handle 60) and locking pawl 64. Behind ratchet wheel 62 is pinion 52 which is not shown in FIGS. 6 and 7 but shown in FIGS. 3 and 4. Upper pawl 63 is biased toward the teeth of the ratchet wheel 62 by spring 66 attached to handle 60 and pawl 64 is biased toward the teeth of the ratchet wheel by spring 68 attached to the frame wall of tensioning unit 10.

Pawl 64 has pivotally attached to it a double cam 81 consisting of a full sized cam 82 shown partially in dotted lines and positioned behind pawl 64 as shown in FIG. 7 and a cam 84 in front of pawl 64 as shown in FIGS. 6 and 7 which is identical to cam 82 except that the upper left hand portion is removed as defined by diagonal edge. Release of the chain tension is accomplished when this double cam 81 is rotated to the position shown in FIGS. 6 and 7. When handle 60 is rotated clockwise as shown in FIG. 6 the upper left hand corner of full sized cam 82 engages pin 88 extending through and carried by pawl 63 thus in turn lifting pawl 63 out of engagement with the tooth of the ratchet wheel 62 as shown. Pawls 63 and 64 are thus dimensioned such that when pawl 63 is lifted out of engagement with the tooth of the ratchet wheel 62, the ratchet wheel rotates slightly clockwise due to the tension provided by springs 53 and 54, and ratchet wheel 62 engages and is stopped by pawl 64 which thereby assumes the load of maintaining chain tension. Thereafter, handle 60 is rotated counterclockwise until the lower end 90 engages the lower portion of front cam 84 as shown thus causing pawl 64 to lift out of engagement with the ratchet wheel tooth and permitting the ratchet wheel and pinion to rotate clockwise further by the tension forces provided by springs 53 and 54 until pawl 63 engages the next tooth and thereby assumes the load. Thus, this rotation of pinion 62 causes movement of associated racks 48 and 50 away from each other thereby releasing the tension of chains 38 and 40. Full release is accomplished by sequentially repeating the "back and forth" rotational motion of the handle as described which is similar to the well known release motion of an auto bumper jack.

Figure 9:
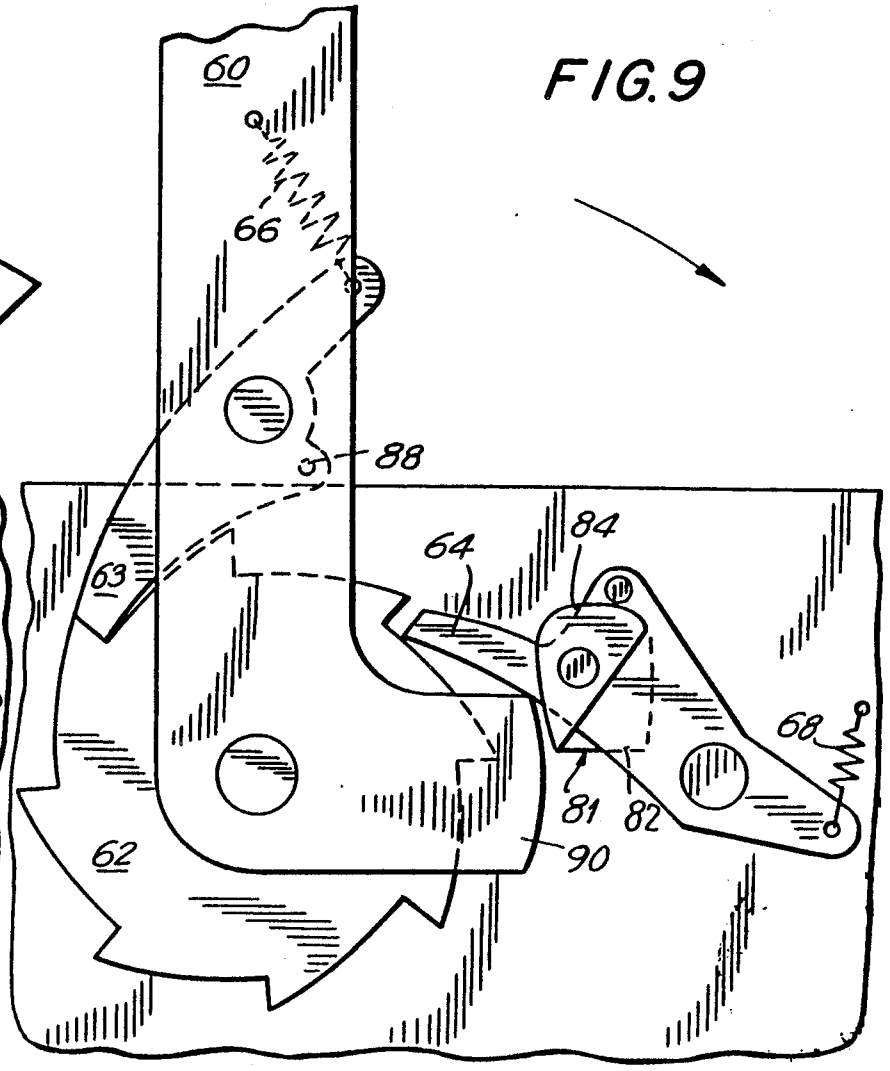
FIGS. 8 and 9 are enlarged views illustrating the tension applying mechanism for the wheel tie-down chains.
Figure 8:
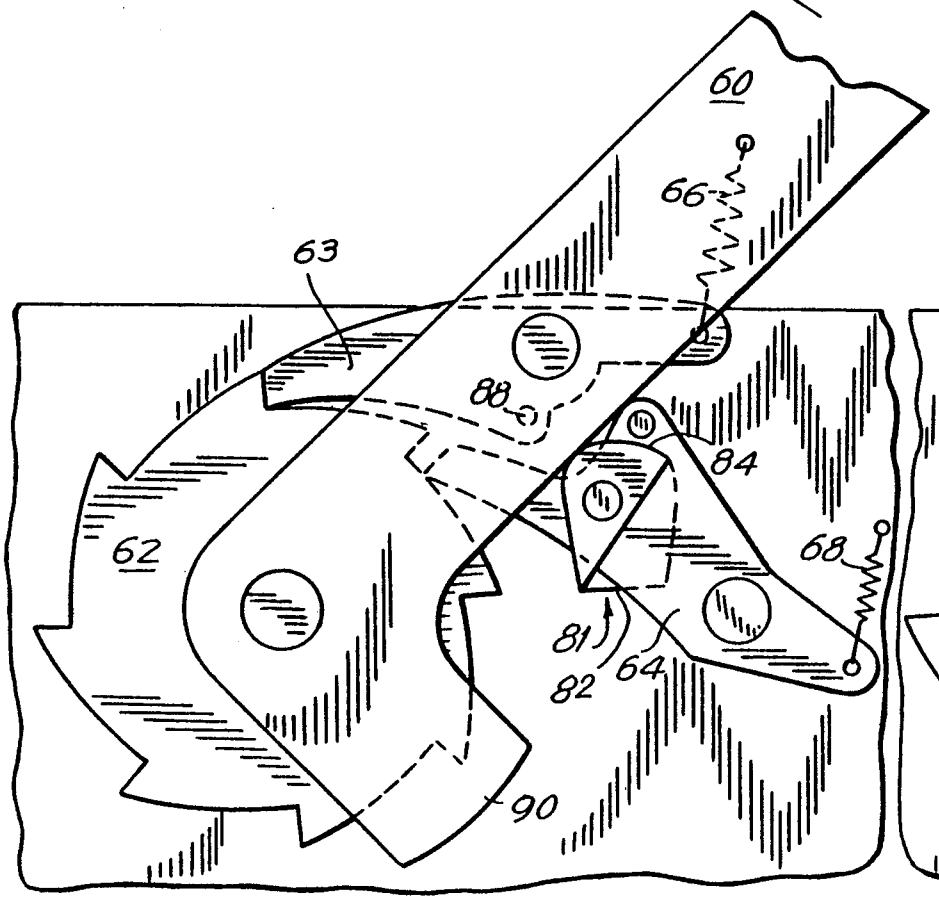

The structure and sequential steps for tensioning chains 38 and 40 will now be described with reference to FIGS. 8 and 9. In FIGS. 8 and 9 the arrows show the direction of the handle at the beginning of each stroke as shown. When a vehicle is in position awaiting tie-down and the harnesses 20 and 22 have been positioned about the forward and aft wheels of the vehicle utilizing the "T" hooks 32 and 34 and brackets 42 and 44 as described, the next step in the tie-down procedure is to apply tension to chains 38 and 40. This is accomplished by rotating the double cam 81 to the upright position shown in FIGS. 8 and 9 and thereafter rotating handle 60 with the same "back and forth" motion utilized for releasing chain tensioning. The difference here is that the cam portions are thus inactivated from interfering with the natural motion and motion of the handle 60 and pawls 63 and 64.

Rotation of handle 60 in a counterclockwise direction as shown in FIG. 8 causes pawl 63 to rotate ratchet wheel 62 by engagement of pawl 63 with the tooth of the ratchet wheel as shown. As this rotation continues pawl 64 in turn remains in its engaged position biased against the surface of the ratchet wheel 62 by spring 68 while associated ratchet wheel tooth slides past the tip of the pawl. Ultimately, as the ratchet wheel 62 continues to rotate counterclockwise, pawl 64 drops into engaged position with the next available tooth of ratchet wheel 62 as shown in FIG. 9. This action is caused by virtue of the bias force of spring 68 and thus action thereby transfers the chain tension load to pawl 64 and permits handle 60 to be rotated clockwise once again to engage the next available ratchet wheel tooth for sequential and continued counterclockwise rotation of the ratchet wheel 62. This rotation of ratchet wheel 62 is accompanied by corresponding rotation of pinion 52 positioned behind the ratchet wheel 62 as shown in FIGS. 3 and 4 with the counterclockwise rotation of the pinion 52 causing corresponding movement of racks 48 and 50 toward each other with resultant tensioning of springs 53 and 54 as well as tensioning of chains 40 and 38.

It can be seen that when chains 40 and 38 and respective springs 52 and 54 are maintained in tension to secure the wheels of a vehicle to slotted base plate 12 and thereby to the associated deck, the tension is continuously maintained by the springs 52 and 54 at all times. In fact in a preferred embodiment the take-up capability of the portion of the length of each chain 38 and 40 ranges from between 14 to 16 inches. This continuous application of tension on chains 38 and 40 retains the wheels of the vehicle securely tied down to the base plate 12 while permitting the vehicle to ride free on its own suspension. Furthermore, the tension which is continuously applied to chains 38 and 40 is readily available and utilized in instances where unwanted occurrences occur such as partial or fully flattening of a tire or even temporary extreme crushing of a tire which has been known to be caused by impact of the main carrier vehicle with another object. In particular, it has been found that such extreme crushing of a tire due to impact of the main carrier vehicle often is temporary with the tire coming back to its original shape. With prior art devices such extensive crushing of the tire actually causes changes in the tie-down systems such as stretching or releasing of components or the like with the result that when the tire returned to its original configuration the tie-down tension had been relieved and the vehicle was free to move on its support. Thus, such prior art devices were deficient in this respect.

With the present invention any major changes in tire configuration or the like causes the chains 40 and 38 to become increasingly tensioned and this tension is maintained by the ratchet wheel and pawl arrangements of brackets 42 and 44 às described. The advantage of the present arrangement is that upon return to status quo, the vehicle will be tied down even tighter than before the temporary change in configuration occurred. In particular, it has been found that in one preferred embodiment an impact of the carrier vehicle occurred at 13. 6 mph causing severe temporary distortion of one of the tires of the vehicle to the extent that the steel rim of the wheel shifted toward the deck plate and was actually prevented to move forward only by the thickness of the rubber tire, indicating that at least at one location the tire was almost completely collapsed. However, after impact the tire assumed its original shape once again and the tie-down apparatus according to the present invention had maintained the wheels of the vehicle in position by tension on the chains 38 and 40 which was substantially greater than the tension originally applied. This result was caused by the fact that the tension which was continuously applied springs 53 and 54 caused the chains to immediately take-up any temporary available slack in the system when the distortion occurred, while the tie-down brackets 42 and 44 and associated ratchet wheels and pawls (such as wheel 76 and pawl 80 shown in FIG. 11) prevented release of the increased tension thus applied. This action causes the load applied by springs 53 and 54 to be effectively transferred to the base plate 12 and the associated deck.

Referring now to FIGS. 12 through 18 there is illustrated an alternative embodiment of the invention as applied to securing wheeled vehicles in a manner similar to the embodiment illustrated in FIGS. 1–10. For convenience of illustration, the apparatus and system disclosed in FIGS. 12–18 is identified by reference numerals beginning with the number "100".

Figures 12, 13:
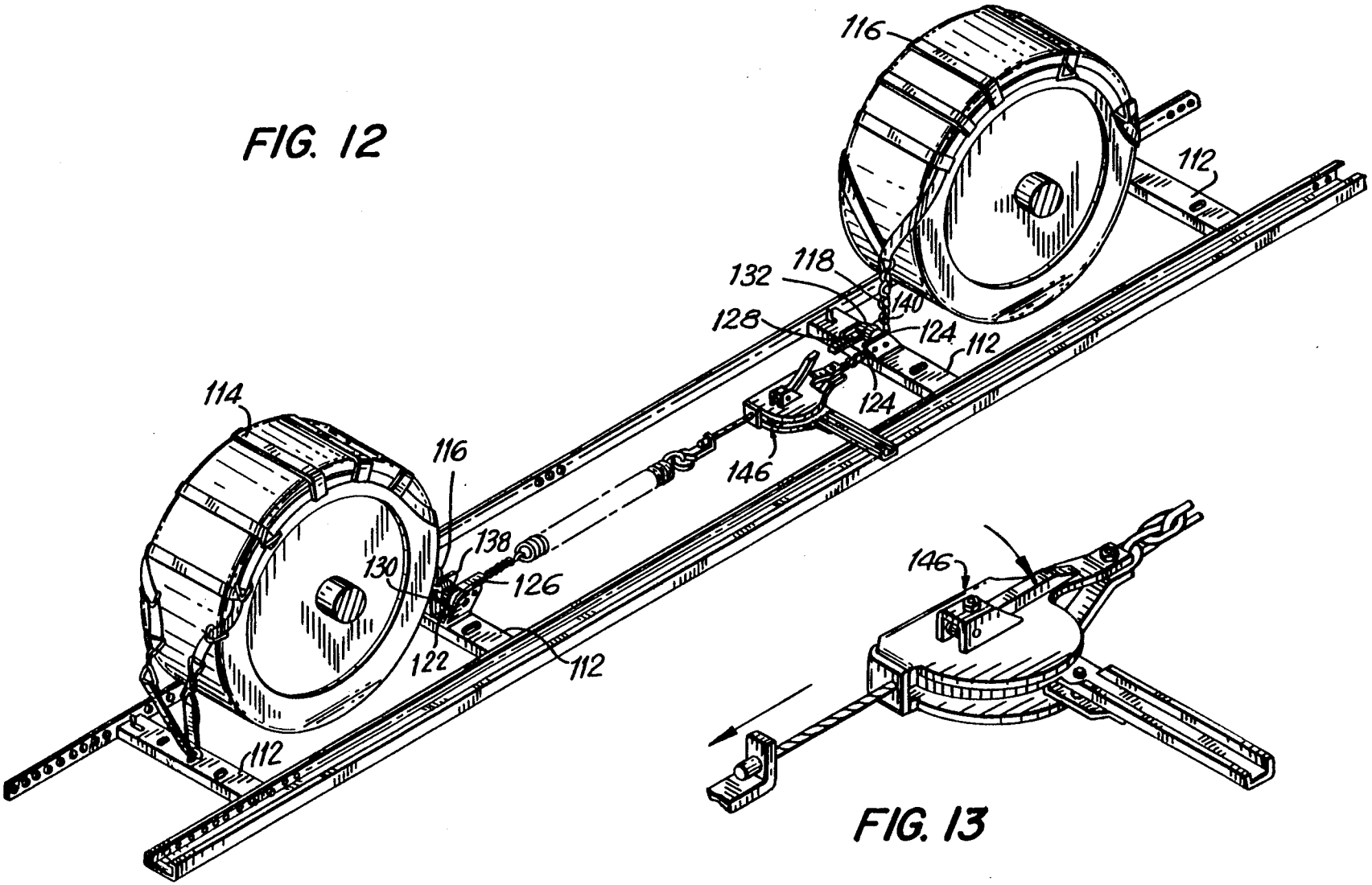
FIG. 12 is a perspective view of an alternative arrangement for tying down a wheeled vehicle with the actual body removed for convenience of illustration, and including a tensioning and quick release apparatus according to the present invention.
FIG. 13 is an enlarged perspective view of the chain tensioning and quick release apparatus shown in FIG. 12.

In FIG. 12 the apparatus 110 is illustrated to secure two wheels of a vehicle to a railway car, for example. For convenience, the remaining portions of the vehicle are not illustrated. In many respects, the apparatus 100 is similar to the previous embodiment described. This system includes deck plates 112 which are inserted into existing holes on a railway car and include strap harnesses 114 and 116 as previously described. In accordance with the basic and broadest aspect of the invention, there is provided a system for maintaining tension on the cargo while permitting the take-up of any slack occurring during transit, without loss of tension. Chains 116 and 118 are each respectively connected to a device 122, 124 which includes a suitable chain pocket wheel connected to ratchet wheel—pawl assemblies 130, 32/126, 128 which retain any predetermined tension applied to the chain of each wheel in order to secure the wheels firmly to the base support via the plates 11 which are firmly attached to the railroad car. This feature is extremely significant in that any tension which is applied to each wheel is firmly and continuously applied because the pawls 126, 128 engage the respective ratchet wheel assembly 130, 132 and apply the tension to chain 116, 118 through the respective pocket wheel 138, 140.

Figure 11:
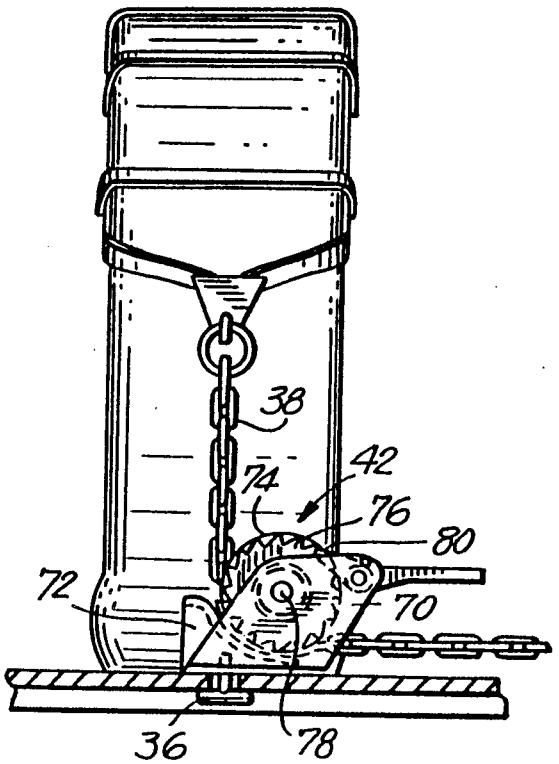
FIG. 11 is a front view of the wheel of FIG. 10 tied down to a deck plate with a corresponding front view of the means for maintaining chain tension.

Referring further to FIG. 12, a spring 142 retains the tension on the chains 116, 118 such that in the event there is any loosening of the harnesses on each wheel for any reason the springs—which are in tension—automatically take up the slack in both chains and harnesses thereby causing the pawl and ratchet wheel to rotate progressively further to the next adjacent tooth on each ratchet wheel; however, movement of each harness in the direction of relaxation of tension is not permitted by reason of the position of the pawl in the gear wheel in a manner more clearly illustrated in the previous embodiment, see, for example, FIGS. 10 and 11; see also FIGS. 19–22.

Figure 14:
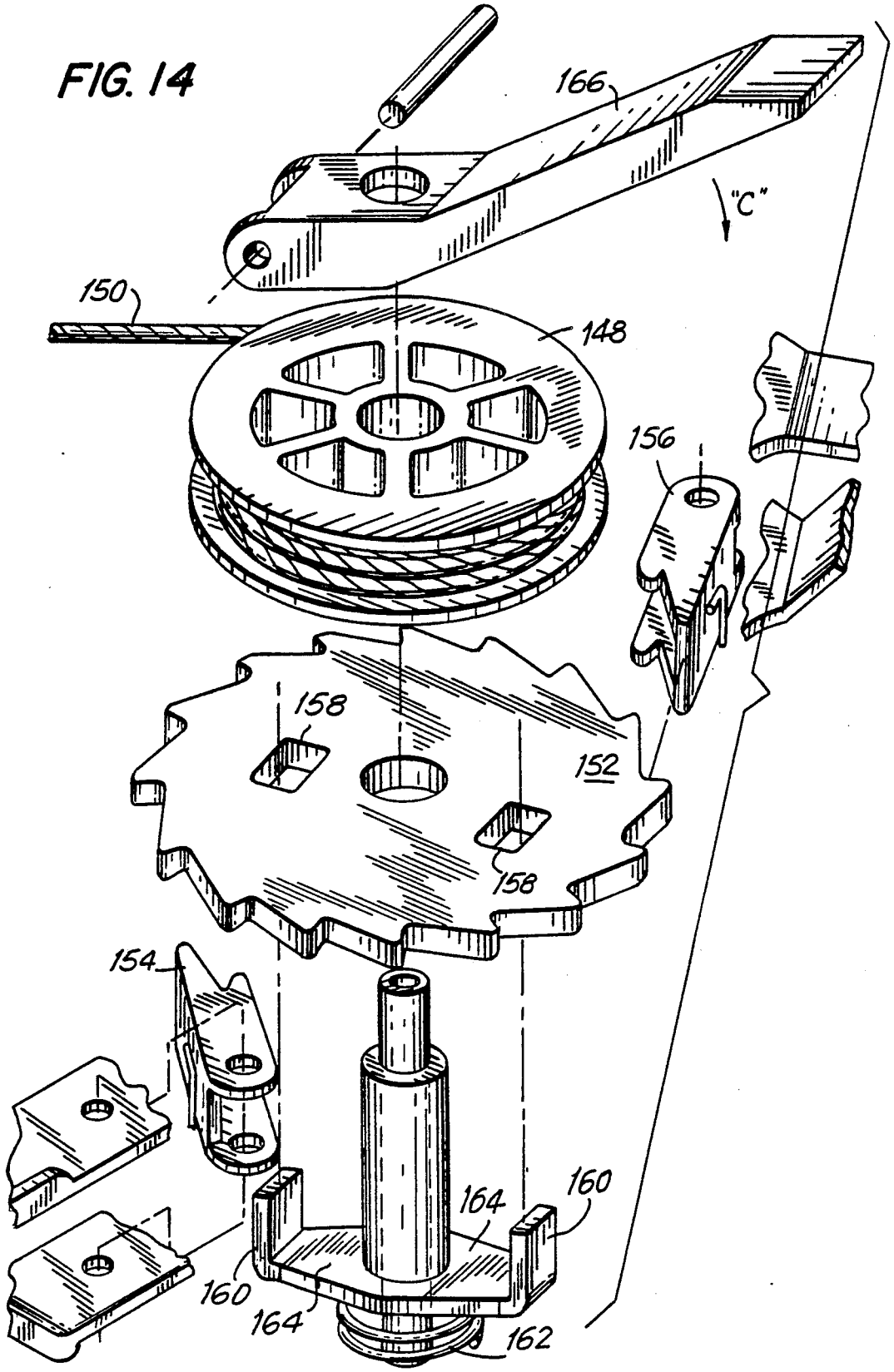
FIG. 14 is an enlarged view with parts separated for illustration purposes, of the tensioning and quick release apparatus shown in FIG. 12.
Figure 15:
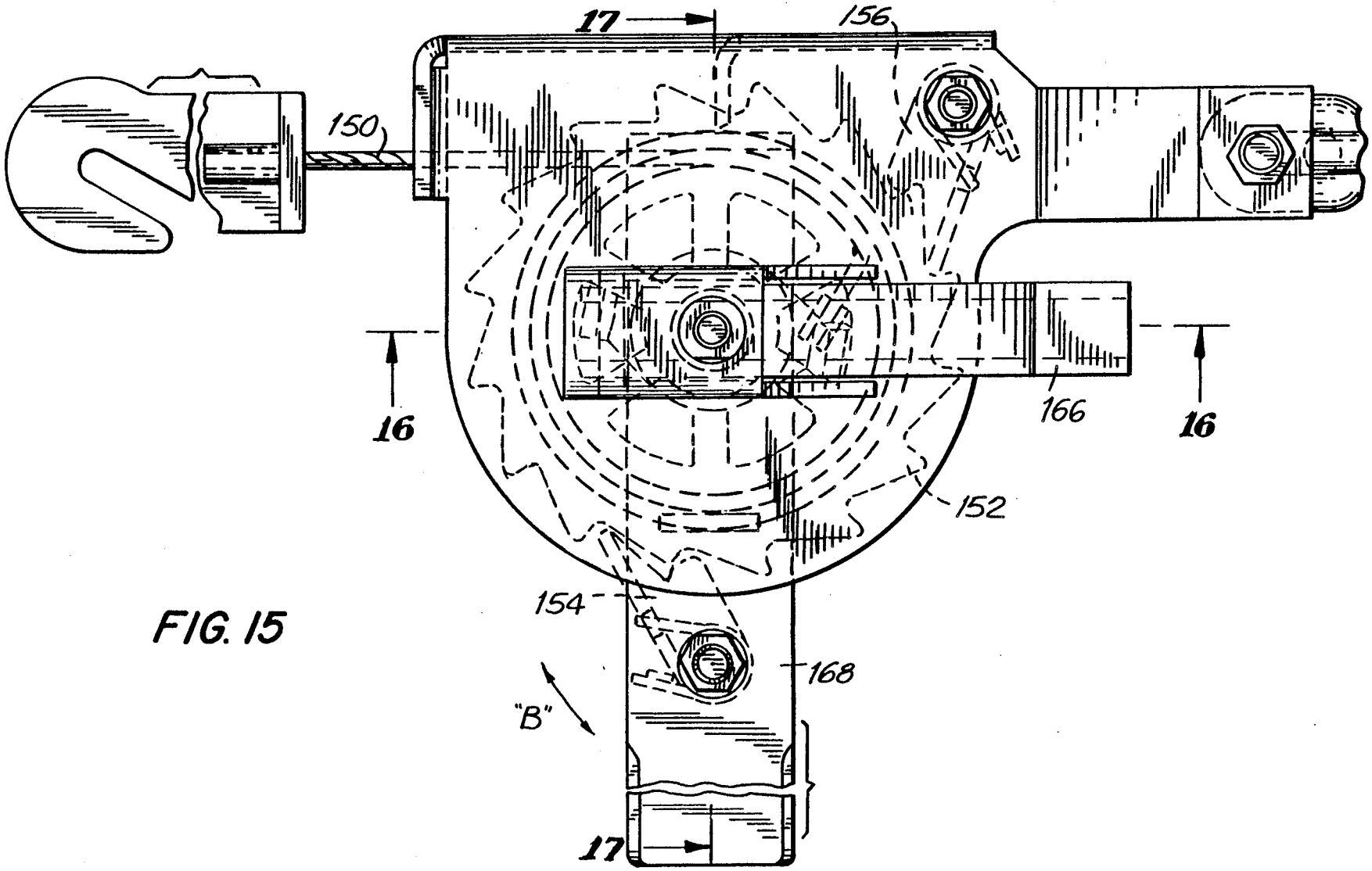
FIG. 15 is a top plan view of the tensioning and quick release apparatus shown in FIG. 12.
Figure 16:
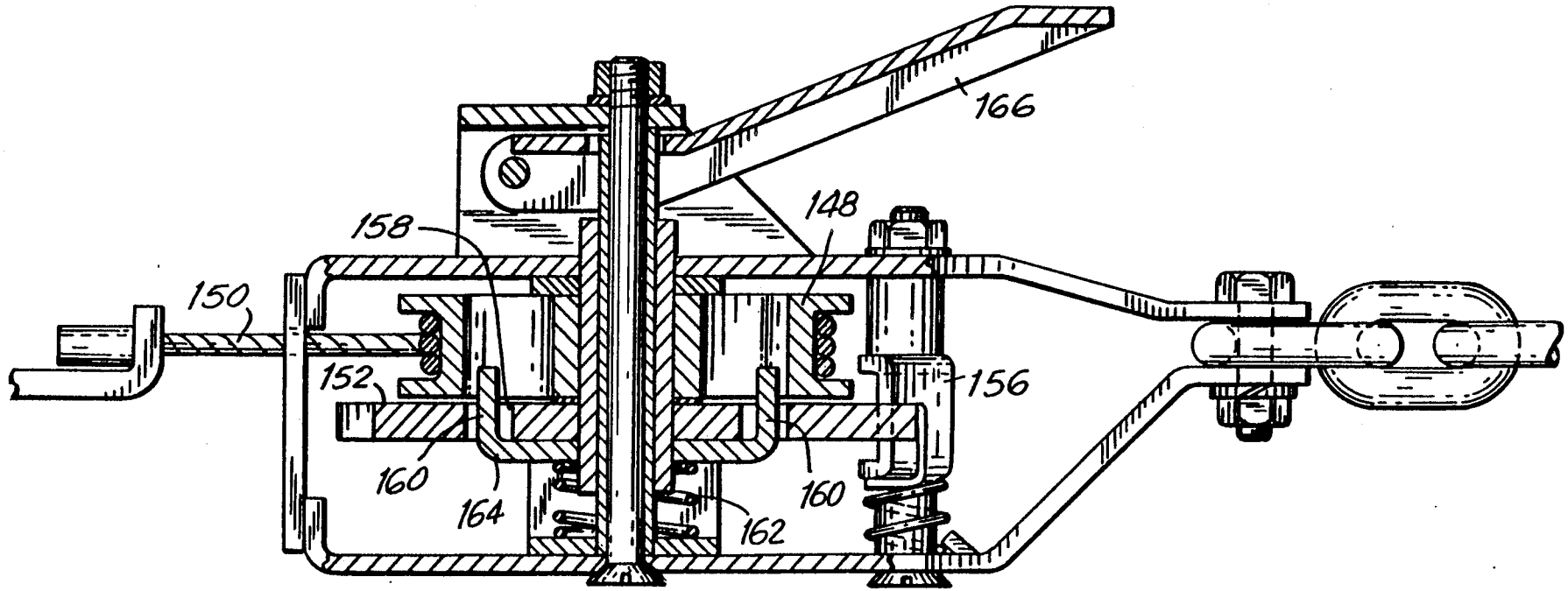
FIG. 16 is a view partially in cross-section, taken along lines 16—16 of FIG. 15 illustrating the tensioning and quick release apparatus shown in FIG. 12.
Figure 17:
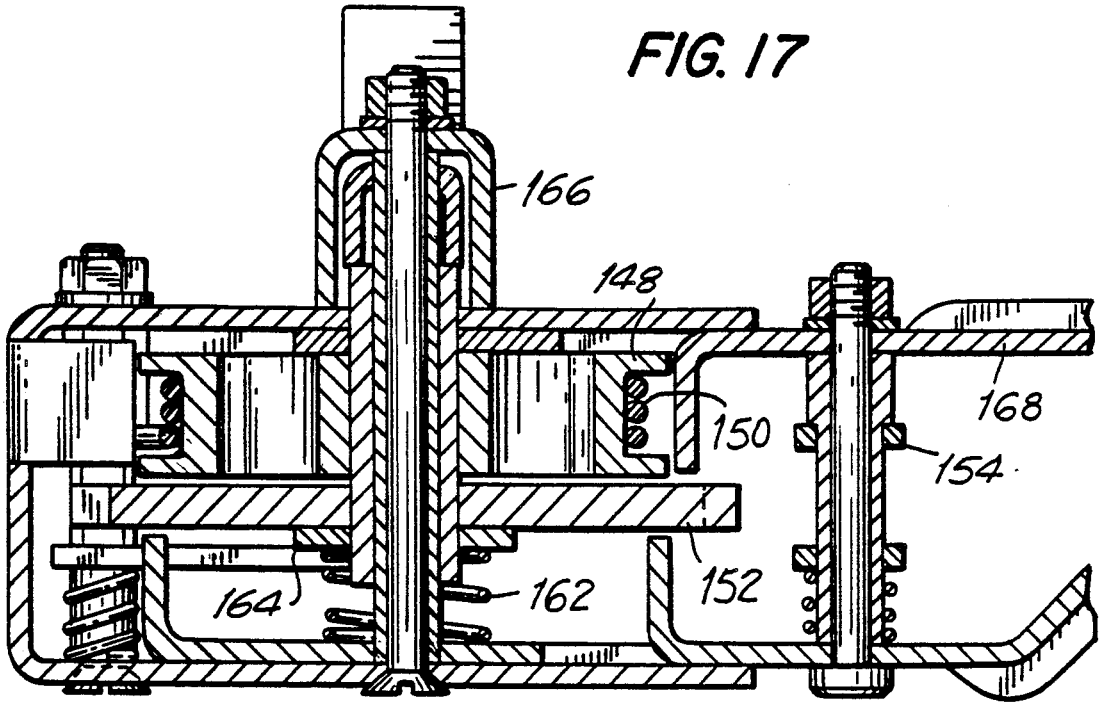
FIG. 17 is a view partially in cross-section, taken along lines 17—17 of FIG. 15 illustrating further features of the tensioning and quick release apparatus shown in FIG. 12.
Figure 18:
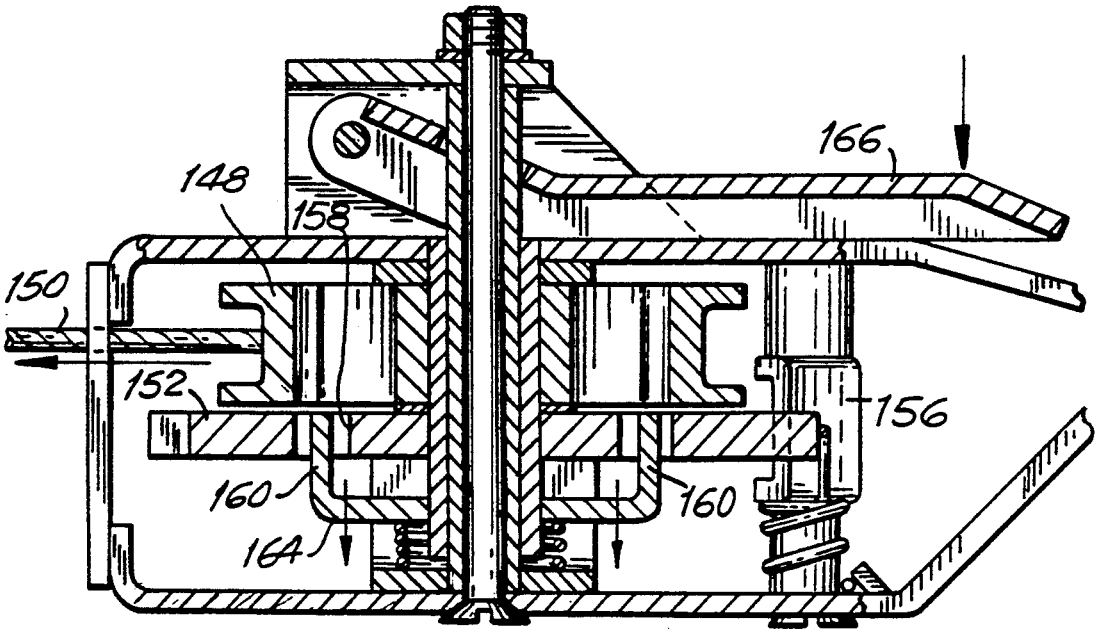
FIG. 18 is a view partially in cross-section of the tensioning and quick release apparatus shown in FIG. 12, in the "release-mode"

Referring further to FIG. 12 there is illustrated a feature of the chain tensioning mechanism 144 which includes a quick release device 146 illustrated more clearly in FIGS. 14 through 18. The quick release device includes a cable wheel 148 around which cable 150 is wound, a ratchet wheel 152 and pawls 154, 156 arranged to engage gear wheel 152. Ratchet wheel 152 includes apertures 158 which receive clutch pins 160 by the force of spring 162 acting upwardly on the common base 164. Release handle 166 is shown in FIG. 14 while rotatably mounted tension application handle 168 is shown in FIG. 15. When tension is to be applied to the chains and harness as shown in FIG. 12, handle 168 is rotated back and forth as shown by arrows B in FIG. 14 whereby pawls 154, 156 cause gear wheel 152 to rotate thereby causing cable 150 to be wound about wheel 148 thereby applying tension to the respective chains and harnesses. As the ratchet wheel 152 is rotated, pawls 154, 156, which are spring loaded against the gear teeth by springs 170, sequentially engage the rotating teeth such that when rotation stops both pawls 156 and 154 maintain the position of the ratchet wheel and the resultant tension on the chains 116, 118 and cargo wheels. This additional support is supplementary to the main interface provided by pocket wheel/ratchet wheel/-pawl assembly 130 and 132 which function primarily to isolate the tension on the cargo from the spring on the winding and unwinding mechanism.

To release the cable, handle 166 is depressed toward the body house 172 as shown by arrow "C" in FIG. 14. This action pushes plate 164 against spring 162 and disengages the clutch pins 160 from the ratchet wheel 152 causing cable spool 148 to release the tension in cable 150. This relaxation of the load due to the orientation and configuration of the teeth on the ratchet gear in engagement with each pawl 154, 156. As mentioned previously, relaxation of the tension on the cargo load is readily provided by the free rotation of the respective ratchet wheels on the ratchet wheel assemblies 130, 132/126, 128, in the unloading direction as illustrated clearly in FIG. 11, for example, in connection with the previous embodiment. However, as mentioned previously, these ratchet gear teeth and respective pawls are particularly dimensioned and oriented to prevent relaxation of the load on the cargo once it is applied, as shown for example in FIGS. 11 and 19.

Figure 19:
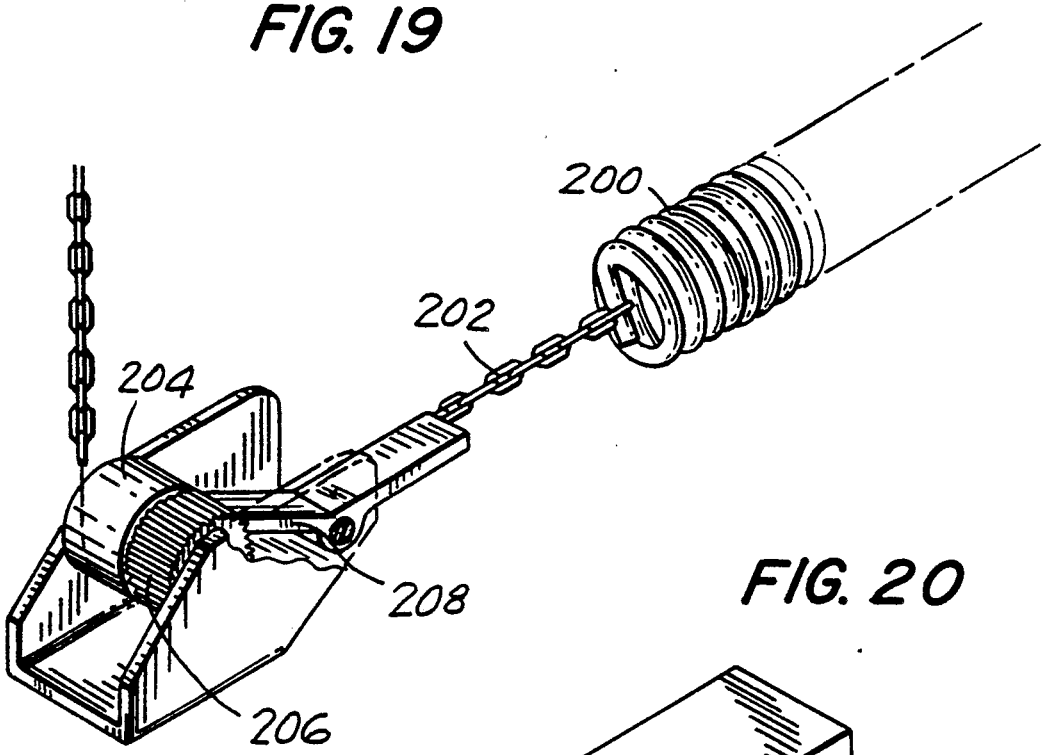
FIG. 19 is a perspective view illustrating broadly the general inventive principal embodied in the present invention.

Referring now to FIGS. 19 through 22 there is illustrated schematically several alternative applications of what is believed to be the major inventive feature of the present invention. In particular, this feature includes the provision of tension maintaining means between the tension application means and the actual cargo. Although in the previous embodiments the invention was described in connection with securing wheeled vehicles to a base support such as a railroad car or alternative base support, it should be made clear particularly by FIGS. 19–22 that the number of applications of the present invention are legion and that the present invention may be utilized in numerous areas of securing cargo generally. As noted in FIG. 19, spring 200 applies tension by the action of a suitable tension applying device (shown previously) to chain 202 which extends past and engages pocket wheel 204. Although the pocket wheel shown in FIG. 19 is schematically illustrated this pocket wheel actually includes appropriately dimensioned and oriented pockets to retain the chain 202 in a manner identical to the pocket wheels shown in the FIGS. in the previous embodiments, see FIGS. 4 and 5, for example. Also, ratchet wheel 206 is co-axial with pocket wheel 204 and rigidly connected for rotation therewith and is engaged by pawl 208 at its periphery such that the engagement between the pawl and the ratchet wheel prevent relaxation of tension on the cargo, i.e. chain 202, but permit further take up as may be required by shifting of the cargo or changes in the cargo configuration or dimensions during transit.

Figure 20:
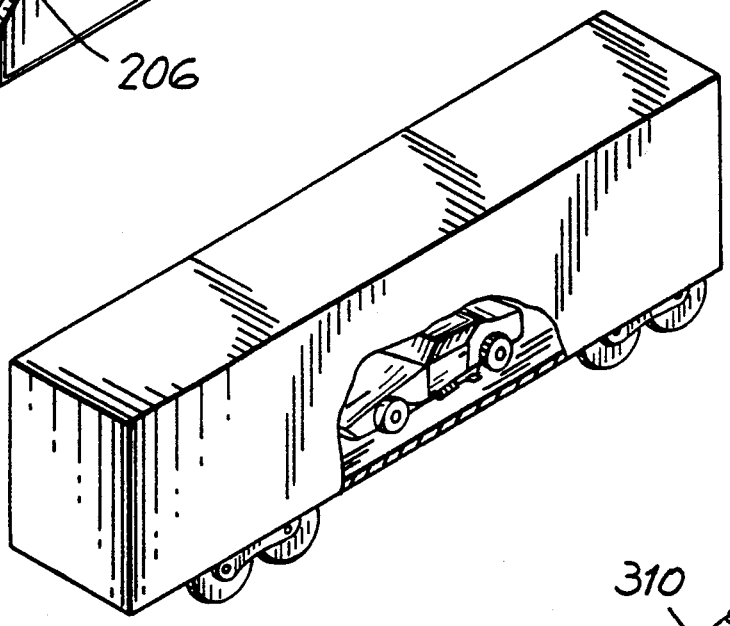
FIG. 20 is a perspective partially cut-away view of an embodiment of the invention as applied to securing automobiles within larger wheeled vehicles.
Figure 20A:
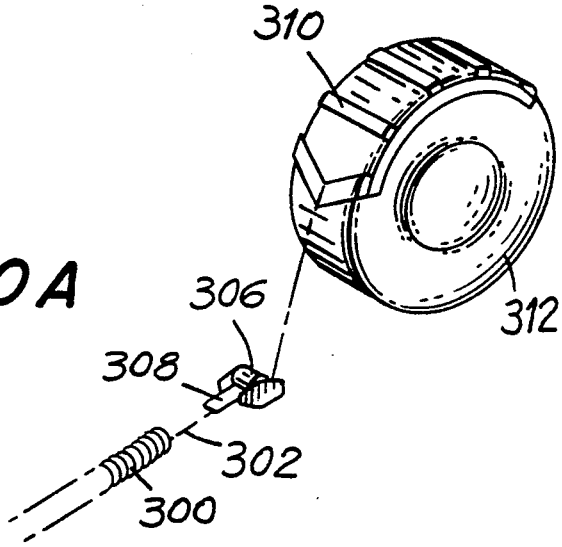
FIG. 20A is an enlarged perspective view of the wheel of the vehicle shown in FIG. 20 illustrating the general inventive principle of the present invention.

Referring now to FIGS. 20 and 20A there is shown schematically an application of the basic invention to secure a wheel of a wheeled vehicle on a base support of a larger vehicle such as a multi-wheeled trailer truck. In this example, spring 300 acts on chain 302 which is schematically shown in dotted lines and the combination of pocket wheel 304 with gear wheel 306 and pawl 308 provided isolation of the tension load on the wheels of the vehicle being transported with respect to the previous embodiments. Again, the same major feature is operative, namely, that the tension on the harness 310 positioned about wheel 312 is maintained by the engagement of ratchet wheel 306 by pawl 308. This engagement also isolates the tension spring 300. Thus, any shifting of the cargo or changing of its configuration will not substantially affect the tension load to wheel 312 by harness 310 because the tensioned spring 300 will take up any additional slack automatically while the teeth of ratchet wheel 306 are permitted to sequentially engage pawl 308 as pocket wheel 304 rotates in the direction of increasing tension on harness 310.

Referring now to FIG. 21 the present invention is illustrated schematically as applied to cargo 410 in the form of tree logs. In this arrangement spring 400 applies tension to pocket wheel 404 via chain 402 while ratchet wheel 406 is engaged by pawl 408. The tension of the spring 400 is sufficient to apply tension to the harness 412 positioned about the cargo but any loosening of the tension will be prevented by the isolation provided by the combination of pocket wheel 404—ratchet wheel 406—pawl 408 interposed between the spring 400 and the cargo 410. Although it is not shown in FIGS. 21 and 21A, a suitable device 414 to apply tension through the spring 400 and chain 402 would normally be included on the side of the spring opposite the pocket wheel arrangement.

Referring lastly to FIG. 22 there is illustrated an arrangement which utilizes the present invention for securing cargo 510 such as lumber on a wheeled vehicle trailer. Spring 500 is connected to chain 502 and extends past a pocket wheel 504—ratchet wheel 506—pawl 508 arrangement similar to the arrangements previously described. Chain 502 is connected to harness 512 extending about the cargo. Once again, as previously described the spring and chain combination maintains a predetermined tension force on the cargo and is continuously available to increase the tension force in the event any changes occur in the configuration of the cargo. At the same time, the pocket wheel 504—ratchet wheel 506—pawl 508 combination is interposed between the spring 500 and a suitable tension application mechanism (shown schematically at 514) which may be utilized, and the cargo 510 such that the predetermined tension is maintained continuously about the cargo. Upon any relaxation of the tension, the spring will automatically increase the tension and the ratchet wheel 506 will sequentially rotate in the direction of increasing chain tension while pawl 508 sequentially engages the teeth.

As can be seen from the foregoing the present invention in its broadest aspect accomplishes what previous cargo securing systems failed to accomplish, namely, securing the cargo by a tension force which is continuously applied and which is automatically increased when the tension force decreases due to any reason as for example shifting of the cargo, loss of a portion of the cargo, etc.

As noted previously, it is the combination of the mechanism which isolates the tension from the spring in the increasing tension direction but permits the spring to increase the tension as needed about the cargo which is believed to be a significant feature of the present invention.

I claim:

1. Apparatus for tying down wheeled vehicles to a base support which comprises:

a. means for tying down a first wheel of a vehicle to a base support;

b. means for tying down a second wheel correspondingly positioned in tandem with the first wheel;

c. means for continuously applying tension to said tie-down means of said first and second wheels; and d. means interposed between said tensioning means and said first and second wheels for rigidly securing said tying means to said base support respectively with respect to each wheel so as to prevent relaxation of tension applied thereto.

2. Apparatus for tying down a wheeled vehicle to a base support, the vehicle having at least a first front wheel and a second rear wheel positioned in general tandem alignment with the front wheel, which comprises:

a. first wheel tie-down means for encompassing at least a portion of the first wheel, said first wheel tie-down means having means at a first end portion for securement thereof to said base support;

b. second wheel tie-down means for encompassing at least a portion of the second wheel, said second wheel tie-down means having means at a first end portion for securement thereof to said base support;

c. means for selectively and simultaneously applying tension to at least one end portion of each of said first and second wheel tie-down means;

d. means interposed between said tension applying means and said first wheel tie-down means for rigidly securing said first wheel tie-down means to the base support at a second end portion so as to prevent relaxation of tension applied to said first wheel while permitting the application of additional tension as required; and e. means interposed between said tension applying means and said second wheel for rigidly securing said second wheel tie-down means to the base support at a second end portion so as to prevent relaxation of tension applied to said second wheel while permitting the application of additional tension as required.

3. The apparatus according to claim 2 wherein said base support means is a support plate defining a plurality of slots for reception of wheel tie-down devices.

4. The apparatus according to claim 3 wherein said first wheel tie-down means comprises a wheel harness adapted to encompass at least a portion of the first wheel and including tie-down hook means dimensioned and configured for insertion into said slots of said base support plate and rotated to interference relation therewith.

5. The apparatus according to claim 4 wherein said second wheel tie-down means comprises a wheel harness adapted to encompass at least a portion of the second wheel and including tie-down hook means dimensioned and configured for insertion into said slots of said base support plate and rotated to interference relation therewith.

6. The apparatus according to claim 5 wherein said first wheel harness is constructed at least in part of synthetic fiber webbing and includes more than one end straps spaced from each other, each end strap having a hook-type tie-down means connected thereto, the spacing of said end straps facilitating initial tie-down of wheels of several sizes.

7. The apparatus according to claim 6 wherein said second wheel harness is constructed at least in part of synthetic fiber webbing and includes more than one end straps spaced from each other, each end strap having a hook-type tie-down means connected thereto, the spacing of said end straps facilitating initial tie-down of wheels of several sizes.

8. The apparatus according to claim 2 further comprising a wheel tie-down chain connected to opposed end portions of each of said first and second wheel tie-down means at one end portion and to said means for maintaining tension on said first and second tie-down means at the other end portion.

9. The apparatus according to claim 8 wherein said means for maintaining tension on said wheel tie-down chains comprises oppositely positioned elongated gear racks supported and connected for movement toward and away from each other and each communicating at one end with a respective wheel tie-down chain respectively associated with each of said first and second wheels.

10. The apparatus according to claim 9 where said means for maintaining tension on each of said first and second wheel chains comprises spring means each respectively connected at one end to one end of an associated elongated rack member and at the other end to an associated wheel chain.

11. The apparatus according to claim 10 wherein each said spring means is a coil spring.

12. The apparatus according to claim 11 further comprising rack moving means supported and arranged for selective rotatable engagement with said elongated rack means for applying forces to said rack means to selectively shift said elongated rack means toward and away from each other.

13. The apparatus according to claim 12 wherein said rack moving means comprises a pinion gear positioned for selective rotation to maintain said elongated rack members in predetermined opposed relative positions to apply predetermined tension to said wheel chains.

14. The apparatus according to claim 13 wherein means is provided for maintaining said pinion gear in a predetermined position relative to said elongated gear racks which comprises ratchet means connected for rotation with said pinion gear and two pawl means positioned for respective engagement with peripherally positioned ratchet teeth on said ratchet means, said pawl means retaining said ratchet means in predetermined sequential rotational positions along with said pinion gear relative to said elongated gear racks.

15. The apparatus according to claim 14 wherein said pawl means comprises at least two pawls pivotally arranged and biased for selective and sequential movement into and out of engagement with the teeth of said ratchet means such that rotation of said ratchet means and said pinion gear against the tension forces provided by said resilient spring means alternately transfers the forces from said tension between said first and second pawls as said ratchet means and said pinion means are simultaneously rotated.

16. The apparatus according to claim 15 further comprising handle means connected for rotation with said ratchet means and said pinion means for providing selective rotation of said ratchet means and said pinion means when said handle means is rotated to thereby cause said elongated gear racks to move in parallel directions toward each other to apply tension to said wheel chains.

17. The apparatus according to claim 16 further comprising means for releasing tension applied to said elongated gear racks and said wheel chains.

18. The apparatus according to claim 17 wherein said means for releasing tension to said elongated gear racks and said wheel chains comprises cam means pivotally attached to one of said pawls and dimensioned and configured for engagement by at least a portion of said handle means when said handle means is rotated in a predetermined direction relative to said pawls to sequentially disengage each of said pawls from said ratchet means so as to facilitate corresponding stepped rotation of said ratchet means and said pinion means in a direction to cause said elongated rack members to move away from each other to thereby reduce the tension applied to said chain means.

19. The apparatus according to claim 18 wherein said cam means is pivotally attached to a first one of said pawls and a second one of said pawls is pivotally mounted to said handle such that when said cam means is oriented in a first position, a portion of said cam means engages a portion of said second pawl in a manner to disengage said second pawl from the tooth of said ratchet means when said handle is rotated in a first direction and rotation of said handle in the opposite direction causes the end portion of the handle to engage said cam means and said first mentioned pawl to release said first mentioned pawl from engagement with a tooth of said ratchet such that alternate movement of said handle in said first and second directions permits rotation of said ratchet and said pinion in a direction which causes said rack members to move in parallel fashion away from each other thereby releasing the tension on said wheel chains.

20. The apparatus according to claim 19 wherein said ratchet means comprises a ratchet wheel and at least two pawls positioned adjacent to each other and said ratchet wheel for selective alternate engagement and disengagement with the teeth of said ratchet wheel depending upon the motion of said handle means and the selective orientation of said cam means.

21. The apparatus according to claim 20 further comprising a ratchet wheel and associated pawl means arranged to retain the tension of each of said first and second wheel tie-down chains by connection of said ratchet means to a chain pocket wheel, each respective chain pocket wheel having each respective wheel chain in engagement therewith, said pawl being mounted and biased for automatic engagement with a tooth of the respective ratchet wheel such that the application of tension to each chain will be retained by the engagement of said pawl with the tooth of said ratchet wheel when said tension is applied.

22. The apparatus according to claim 21 wherein each of said tension maintaining ratchet wheels and pawls are supported in a bracket selectively secured to said base support plate by means of a "T" hook having a "T" configuration, each said hook being inserted into a selective adjacent slot in said base support plate and rotated to an interfering relation with said base support plate to prevent removal of said "T" hook when tension is applied thereto by said wheel chains and said tension applying means.

23. Apparatus for tying down a wheeled vehicle to a base support, the vehicle having at least a first front wheel and a second rear wheel positioned in general tandem alignment with the first front wheel, which comprises:

a. base support means dimensioned and configured for supporting at least said first and second wheels of the vehicle;

b. first wheel tie-down means for encompassing at least a portion of the first wheel, said first wheel tie-down means having means at each end portion for securement to said base support and chain means connected to one end portion for applying tie-down forces thereto by applying tension to said chain means;

c. second wheel tie-down means for encompassing at least a portion of the second wheel, said second wheel tie-down means having means at each end portion for securement to said base support and chain means connected to one end portion for applying tie-down forces thereto by applying tension to said chain means;

d. means for selectively and simultaneously applying and maintaining tension to at least one end portion of each of said first and second wheel tie-down means and associated chain means and for continuously maintaining said wheel tie-down means in a predetermined tensioned condition;

e. means interposed between said tension applying means and said first wheel tie-down means for rigidly securing said first wheel tie-down means to the base support means so as to prevent relaxation of tension applied thereto by said tension applying means while permitting increases in tension when the tension decreases below a predetermined value; and f. means interposed between said tension applying means and said second wheel tie-down means for rigidly securing said second wheel tie-down means to the base support means so as to prevent relaxation of tension applied thereto by said tension applying means while permitting increases in tension when the tension decreases below a predetermined value.

24. A system for tying down a wheeled vehicle to a base support, the vehicle having at least a first front wheel and a second rear wheel positioned in tandem alignment with the front wheel which comprises:

a. a base support plate dimensioned and configured for supporting at least said first and second wheels of the vehicle, said base support plate having a plurality of slots positioned for reception of wheel tie-down hooks;

b. a first wheel tie-down harness dimensioned and configured for encompassing at least a portion of the first wheel, said first wheel tie-down harness having a tie-down securement hook positioned at each end for securement to the base support plate;

c. a second wheel tie-down harness dimensioned and configured for encompassing at least a portion of the second wheel, said second wheel tie-down harness having a tie-down securement hook positioned at each end for securement to the base support plate;

d. means for selectively applying and maintaining tension to at least one portion of each of said first and second wheel tie-down harnesses and for continuously maintaining said wheel tie-down harnesses in a predetermined tensioned condition which comprises:

i. a housing;

ii. two opposed toothed gear racks positioned within said housing and mounted for relative parallel movements toward and away from each other;

iii. a pinion mounted within said housing for rotational simultaneous toothed engagement with said gear racks so as to provide movement of said racks toward and away from each other depending upon the direction of said pinion gear;

iv. a coil spring attached to opposed end portions of each gear rack at one end and at the other end, each coil spring being attached to tie-down chains connected to respective opposed end portions of said wheel tie-down harnesses;

v. a toothed ratchet wheel mounted for rotation with said pinion gear and having associated therewith two spaced spring loaded pawls arranged for selective and alternate engagement with the teeth of said ratchet gear as said ratchet gear rotates;

vi. a handle mounted to said housing for pivotal rotation and connected to said ratchet and said pinion so as to simultaneously rotate therewith when said handle is rotated;

vii. cam means rotatably mounted to one of said pawls and being dimensioned and configured such that rotation of said cam means in a first direction causes sequential engagement and disengagement of said pawls so as to release tension on said wheel chains and rotation of said cam means in a second direction removes said cam means into sequential interference relation with said pawls as said handle is rotated in a back and forth motion such that said pawls sequentially rotate said ratchet wheel and pinion in steps and in a direction to cause tensioning of said wheel chains; and viii. a bracket connected to an end portion of each harness to attach each harness to said base support plate and to guide each wheel chain from said harness to said chain tensioning unit, each said bracket containing ratchet and pawl means adapted to maintain tension applied to the associate wheel chain by engagement of the pawl with a tooth on the ratchet to thereby transfer the tension thus applied to each wheel chain and ratchet tooth and said respective bracket and to said base support plate.

25. Apparatus for tying down cargo to a base support which comprises:

(a) tie-down means configured and adapted to encompass and extend about at least a major portion of the cargo sufficient for tying down the cargo, said tie-down means having at least one end portion adapted to be secured to be base support and at least a second end portion adapted for applying tension thereto;

(b) means for directly and continuously applying tension to at least said second end portion of said tie-down means; and (c) means located along said tie-down means, spaced at a distance away from said tension applying means, and interposed between said tension applying means and the first end portion of the tie-down means, for rigidly restraining and securing at least said second end portion of said cargo tie-down means to the base support and for maintaining tension on said cargo tie-down means with respect to the cargo so as to prevent relaxation of tension applied to the cargo by said cargo tie-down means while continuously permitting the application of tension to said cargo tie-down means as required to maintain a predetermined tension while the cargo is restrained.

26. Apparatus for tying down cargo according to claim 25 wherein said means for applying tension includes resilient means.

27. Apparatus for tying down cargo according to claim 26 wherein said means for applying tension comprises manually operable winding means connected to said cargo securing means.

28. Apparatus for tying down cargo according to claim 27 wherein said means interposed between said tensioning means and the cargo comprises mechanical means for rigidly restraining said securing means, said mechanical means including means adapted for engagement therewith for permitting increased application of tension to said securing means as may be required, while simultaneously isolating said securing means under tension from said tension applying means.

29. Apparatus for tying down cargo according to claim 28 wherein said means interposed between said tensioning means and the cargo comprises at least one ratchet wheel and associated pawl means fixed with respect to said base support and engaged with at least one tooth of said ratchet wheel, the teeth of said ratchet wheel being configured and dimensioned such that said pawl means prevents rotation of said ratchet wheel in a direction to relax tension on said securing means and said cargo but permits rotation of said ratchet wheel in the opposite direction by increasing tension applied to said securing means by said resilient means.

30. Apparatus for tying down cargo according to claim 29 wherein said resilient means is a spring.

31. Apparatus for tying down cargo according to claim 30 wherein said spring is a coil spring.

32. Apparatus for tying down cargo according to claim 31 wherein said means for applying tension comprises a gear wheel arranged to be rotated; at least one pawl, said pawl being connected to handle means and said gear wheel being selectively engaged or disengaged by means to retain the position of said gear wheel at a predetermined rotational position corresponding to a predetermined tension applied to said securing means through said gear wheel.

33. Apparatus for tying down cargo according to claim 32 further comprising means to disengage said means to restrain said ratchet wheel to thereby permit relaxation of tension on said securing means by permitting rotation of said ratchet wheel and said restraining means to relieve said tension on said restraining means.

34. Apparatus according to claim 33 wherein said restraining means comprises cable and is connected to a cable spool.

35. Apparatus for tying down cargo according to claim 34 wherein said means to disengage said tension comprises handle means positioned in engagement with means connected to said means to secure said position of said ratchet wheel.

36. Apparatus for tying down cargo according to claim 35 wherein said means to secure the position of said ratchet wheel is operatively engaged with spring means to bias said means to fix the position of said ratchet wheel toward the loaded position.

37. Apparatus for tying down wheeled vehicles to a base support which comprises:

a. first wheel tie-down means configured to encompass at least a portion of a first wheel for tying down the first wheel of the vehicle to the base support, said first wheel tie-down means having means at a first end portion for securement thereof to the base support;

b. second wheel tie-down means configured to encompass at least a portion of a second wheel correspondingly positioned in tandem with the first wheel, said second wheel tie-down means having means at a first end portion for securement thereof to the base support;

c. means for continuously applying tension to at least one end portion of each of said first and second wheel tie-down means;

d. means interposed between said tension applying means and said first wheel for rigidly securing at least one end portion of said first wheel tie-down means directly to said base support with respect to said first wheel so as to prevent relaxation of tension applied thereto while continuously permitting the application of additional tension; and e. means interposed between said tension applying means and said second wheel for rigidly securing at least one end portion of said second wheel tie-down means directly to said base support with respect to said second wheel so as to prevent relaxation of tension applied thereto while continuously permitting the application of additional tension.

38. The apparatus of claim 25 wherein the tension applying means is located at said second end portion of said tie-down means.

* * * * *